US009155184B2

(12) United States Patent
Ng et al.

(10) Patent No.: US 9,155,184 B2
(45) Date of Patent: Oct. 6, 2015

(54) PLASMA GENERATION SOURCE EMPLOYING DIELECTRIC CONDUIT ASSEMBLIES HAVING REMOVABLE INTERFACES AND RELATED ASSEMBLIES AND METHODS

(71) Applicant: Applied Materials, Inc., Santa Clara, CA (US)

(72) Inventors: Siu Tang Ng, Cupertino, CA (US); Changhun Lee, San Jose, CA (US); Huutri Dao, San Jose, CA (US); Roberto Cesar Cotlear, Sunnyvale, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 2 days.

(21) Appl. No.: 14/246,419

(22) Filed: Apr. 7, 2014

(65) Prior Publication Data

US 2015/0137681 A1 May 21, 2015

Related U.S. Application Data

(60) Provisional application No. 61/905,722, filed on Nov. 18, 2013.

(51) Int. Cl.
*H05H 1/24* (2006.01)
*H05H 1/46* (2006.01)

(52) U.S. Cl.
CPC ..... *H05H 1/46* (2013.01)

(58) Field of Classification Search
USPC ..... 315/111.61, 111.41, 111.51, 111.71, 315/111.21; 118/715
See application file for complete search history.

(56) References Cited

U.S. PATENT DOCUMENTS

| | | | | |
|---|---|---|---|---|
| 6,592,709 | B1 * | 7/2003 | Lubomirsky | 156/345.48 |
| 6,975,073 | B2 * | 12/2005 | Wakalopulos | 315/111.81 |
| 7,501,600 | B2 * | 3/2009 | Holber et al. | 219/121.52 |

* cited by examiner

*Primary Examiner* — David H Vu
(74) *Attorney, Agent, or Firm* — Patterson & Sheridan, L.L.P.

(57) ABSTRACT

Plasma generation source employing dielectric conduit assemblies having removable interfaces and related assemblies and methods are disclosed. The plasma generation source (PGS) includes an enclosure body having multiple internal surfaces forming an internal chamber having input and output ports to respectively receive a precursor gas for generation of plasma and to discharge the plasma. A dielectric conduit assembly may guide the gas and the plasma away from the internal surface where particulates may be generated. The dielectric conduit assembly includes a first and second cross-conduit segments. The dielectric conduit assembly further includes parallel conduit segments extending from the second cross-conduit segment to distal ends which removably align with first cross-conduit interfaces of the first cross-conduit segment without leaving gaps. In this manner, the dielectric conduit assembly is easily serviced, and reduces and contains particulate generation away from the output port.

20 Claims, 20 Drawing Sheets

PLASMA GENERATION SOURCE EMPLOYING DIELECTRIC CONDUIT ASSEMBLIES HAVING REMOVABLE INTERFACES AND RELATED ASSEMBLIES AND METHODS

CROSS-REFERENCE TO RELATED APPLICATION

This application claims the benefit of U.S. Provisional Application Ser. No. 61/905,722, entitled "Plasma Generation Sources Employing Dielectric Conduit Assemblies Having Removable Interfaces And Related Assemblies and Methods," and filed Nov. 18, 2013, which is incorporated herein by reference in its entirety.

BACKGROUND

1. Field

Embodiments of the present invention generally relate to a method and apparatus for plasma processing of a substrate and, more specifically, to a method and apparatus for etching a substrate.

2. Description of the Related Art

A plasma generated within a plasma generation source may come into contact with internal surfaces that generate particulates which can contaminate thin layers of a semiconductor structure. One approach to eliminate particulates is to line the internal surfaces with dielectric material conduits, for example quartz liners, which are relatively free of particulate-generation surfaces. Conventionally, the liners are replaced periodically and replacing the liners typically requires gaps between abutting sections or missing sections to permit insertion and removal of the liners.

FIGS. 1A and 1B are a sectional view and a close-up sectional view, respectively, of an exemplary plasma generation system 10 employing a replaceable quartz liner 12 as is known in the art. The plasma generation system 10 may be, for example, a Rapid-O Remote Plasma Source used on a chamber as depicted later in FIG. 8. The quartz liner 12 may be disposed within an enclosure assembly 14 comprising an enclosure body 16 having at least one internal enclosure surface 18 forming an enclosure passageway 20. The enclosure passageway 20 includes an input passageway 22 to receive at least one precursor gas 24 and an output passageway 26 to discharge a plasma 28 created from the precursor gas 24. The plasma 28 may be created from the precursor gas 24 in energizing passageway segments 30A, 30B of the enclosure passageway 20. The energizing passageway segments 30A, 30B are proximate to energy sources 32A, 32B, respectively, which add energy to the precursor gas 24 within the energizing passageway segments 30A, 30B and create the plasma 28.

The enclosure passageway 20 includes other segments. The precursor gas 24 travels via an input passageway segment 34 of the enclosure passageway 20 from the input passageway 22 to the energizing passageway segments 30A, 30B where the plasma 28 is created. The plasma 28 created in the energizing passageway segments 30A, 30B is delivered to the output passageway 26 via an output passageway segment 36. In this manner, the energizing passageway segments 30A, 30B of the enclosure passageway 20 may operate continuously to supply the plasma 28 through the output passageway 26.

Particulates can be generated by the plasma 28 contacting the internal enclosure surface 18 of the enclosure body 16. In order to minimize particulate generation, the quartz liner 12 is placed within the enclosure passageway 20 to guide the plasma 28 away from portions of the internal enclosure surface 18 at the energizing passageway segments 30A, 30B and the output passageway segment 36. The internal enclosure surface 18 at the input passageway segment 34 is free of the quartz liner 12 because removal of a liner segment would require small gaps between liners and erosion of the internal enclosure surface 18 would be accelerated at the small gaps.

In order to better protect the energizing passageway segments 30A, 30B and the output passageway segment 36, the quartz liner 12 may be formed as an integral body comprising energizer liner segments 38A, 38B connected to a cross segment 40 for easy installation into the enclosure body 16. The energizer liner segments 38A, 38B may slide into the energizer passageway segments 30A, 30B and interface with positioner sleeves 42A, 42B of the enclosure body 16 which position the quartz liner 12 within the enclosure passageway 20. The energizer passageway segments 30A, 30B of the quartz liner 12 are positioned to only conventionally extend from the output passageway segment 36 to distal ends 44A, 44B almost reaching the input passageway segment 34. The distal ends 44A, 44B may include angled surfaces 46A, 46B to better guide the at least one precursor gas 24 into the energizer passageway segments 30A, 30B from the input passageway segment 34. In this manner, the quartz liner 12 may be installed and removed from the enclosure passageway 20 to provide easy maintenance by allowing efficient installation and de-installation of the quartz liner 12, and provides a continuous supply of plasma 28.

However, despite the absence of a small gap between segments of the quartz liner 12, the plasma 28 has been discovered in some cases to attack selected portions 48A, 48B of the internal enclosure surface 18 near or near the positioner sleeves 42A, 42B to cause particulates 50 (FIG. 1B). The particulates 50 may fall into the energizer liner segments 38A, 38B where they may then further travel to the output passageway 26 and cause defect-causing contamination downstream of the output passageway 26. FIG. 1C is a top perspective view of the portion 48B of the positioner sleeve 42B and FIG. 2 is an exemplary particulate 50 having a width of two-hundred (200) nanometers which may be generated therefrom. What is needed is a better approach to protect the internal enclosure surface 18 from the plasma 28. The apparatus and/or method should provide ease of maintenance and reduces the probability of the particulates 50 from being generated. The apparatus and/or method should also reduce the probability that any of the particulates 50 generated depart with the plasma from the plasma generation system 10.

One approach is to protect the input passageway segment 34, the energizer passageway segments 30A, 30B, and the output passageway segment 36 with one integral non-removable liner. In this manner, owners of the plasma generation system 10 would need to replace the plasma generation system 10 when the one integral non-removable liner is no longer serviceable. This approach is prohibitively expensive in most cases. Hence, what is also needed is an affordable approach to allow maintenance and associated disassembly of the plasma generation system 10.

SUMMARY

Embodiments disclosed herein include a plasma generation source employing dielectric conduit assemblies having removable interfaces and related assemblies and methods that do not leave gaps between removable liner segments. The plasma generation source (PGS) includes an enclosure body having an internal surface forming an internal chamber having input and output ports to respectively receive a precursor gas for generation of plasma and to discharge the plasma. A dielectric conduit assembly may guide the gas and the plasma away from the internal surface where particulates may be generated. The dielectric conduit assembly includes a first and second cross-conduit segments. The dielectric conduit assembly further includes parallel conduit segments where plasma generation occurs. The parallel conduit segments extend from the second cross-conduit segment to distal ends which removably align with first cross-conduit interfaces of the first cross-conduit segment. In this manner, the dielectric conduit assembly is easily serviced, and reduces and contains particulate generation away from the output port.

In one embodiment a plasma generation source is disclosed. The plasma generation source includes an enclosure assembly including an enclosure body having multiple internal surfaces forming an internal chamber, an input port to receive at least one precursor gas, and an output port to discharge plasma. The plasma generation source includes a dielectric conduit assembly disposed within the internal chamber. The dielectric conduit assembly includes a first cross-conduit segment enclosing a first passageway in communication with the input port. The dielectric conduit assembly also includes a second cross-conduit segment enclosing a second passageway in communication with the output port. The dielectric conduit assembly also includes parallel conduit segments integral to the second cross-conduit segment and extending to distal ends. The plurality of parallel conduit segments encloses an inner space where the plasma is generated from the precursor gas. The inner spaces in communication with the second passageway. The first cross-conduit segment further comprises a plurality of first cross-conduit alignment interfaces to removably align the first cross-conduit segment with the plurality of parallel conduit segments to place the first passageway in communication with the inner spaces without gaps in the dielectric conduit assembly. In this manner, the dielectric conduit assembly may be easily serviceable by enabling efficient assembly and dis-assembly and reducing the opportunity for contaminating particles to be generated.

In another embodiment a method of installing a dielectric conduit assembly into a remote plasma source is disclosed. The method may include providing an enclosure body of the remote plasma source. The enclosure body may be formed with an internal chamber, an input port, and an output port. The method may also include providing the dielectric conduit assembly. The dielectric conduit assembly may include a first cross-conduit segment enclosing a first passageway. The dielectric conduit assembly may also include a second cross-conduit segment enclosing a second passageway. The dielectric conduit assembly may further include at least two parallel conduit segments integral with the second cross-conduit segment and extending to distal ends. Each parallel conduit segment may enclose an inner space in communication with the second passageway. The first cross-conduit segment may have at least two openings for receiving the distal ends of the parallel conduit segments without gaps in the dielectric conduit assembly. In this manner, the dielectric conduit assembly may be installed within the enclosure body and provide a low contamination plasma.

Additional features and advantages will be set forth in the detailed description which follows, and in part will be readily apparent to those skilled in the art from that description or recognized by practicing the embodiments as described herein, including the detailed description that follows, the claims, as well as the appended drawings.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF THE DRAWINGS

So that the manner in which the above recited features of the present invention can be understood in detail, a more particular description of embodiments of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Reference will now be made in detail to the embodiments, examples of which are illustrated in the accompanying drawings, in which some, but not all embodiments are shown. Indeed, the concepts may be embodied in many different forms and should not be construed as limiting herein; rather, these embodiments are provided so that this disclosure will satisfy applicable legal requirements. Whenever possible, like reference numbers will be used to refer to like components or parts.

Embodiments disclosed herein include a plasma generation source employing dielectric conduit assemblies having removable interfaces and related assemblies and methods. The plasma generation source (PGS) includes an enclosure body having an internal surface forming an internal chamber having input and output ports to respectively receive a precursor gas for generation of plasma and to discharge the plasma. A dielectric conduit assembly may guide the gas and the plasma away from the internal surface where particulates may be generated. The dielectric conduit assembly includes a first and second cross-conduit segments. The dielectric conduit assembly further includes parallel conduit segments where plasma generation occurs. The parallel conduit segments are integral with the second cross-conduit segment and extend to distal ends which removably align with first cross-conduit interfaces of the first cross-conduit segment without gaps in the dielectric conduit assembly. In this manner, the dielectric conduit assembly is easily serviced, and reduces and contains particulate generation away from the output port.

Figure 3A:
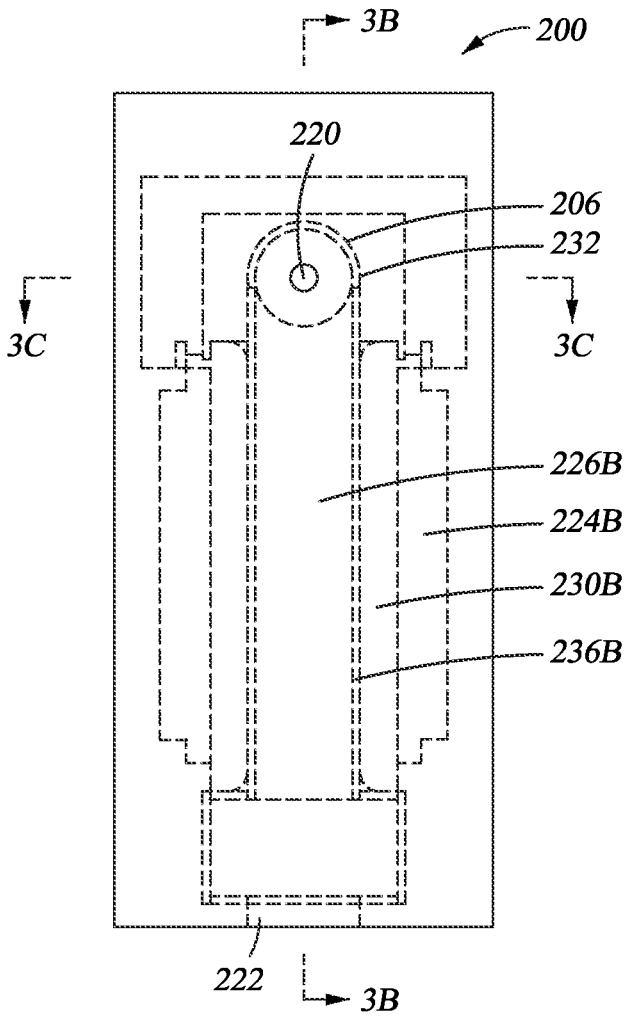
FIGS. 3A through 3D are a front side view, a left-side sectional view, a top perspective sectional view, and a close-up left-side sectional view, respectively, of an exemplary embodiment of a plasma generation source including an exemplary dielectric conduit assembly comprising a first cross-conduit segment including a plurality of first cross-conduit interfaces to align the first cross-conduit segment with a plurality of parallel conduit segments for reducing the generation of particulates within the plasma generation source while enabling the dielectric conduit assembly to be easily installed and de-installed for ease of maintenance.
Figure 3B:
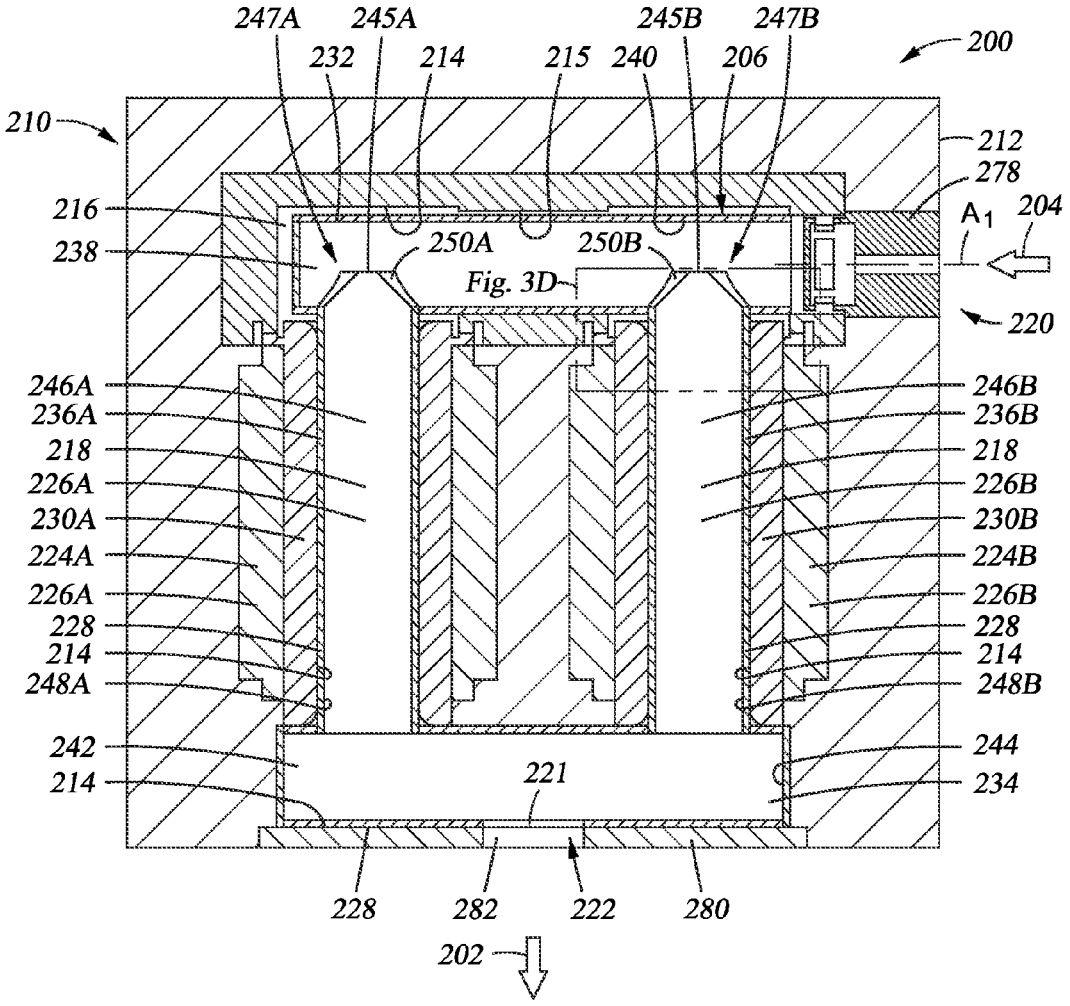

FIGS. 3A and 3B are a front side view and a left-side sectional view, respectively, of an exemplary embodiment of a remote plasma source 200 for generating a plasma 202 from at least one precursor gas 204. The remote plasma source 200 includes an exemplary dielectric conduit assembly 206 that can be easily assembled without gaps between liner segments and easily dis-assembled from the remote plasma source 200 for maintenance. In regards to organization of this disclosure, the remote plasma source 200 will first be discussed with reference to FIGS. 3A through 3D to depict the operation of the dielectric conduit assembly 206 within the remote plasma source 200. Next, details of the dielectric conduit assembly 206 will be discussed relative to FIGS. 4A through 4I. A method of assembly and disassembly of the dielectric conduit assembly 206 will be discussed relative to FIGS. 5 through 7. Next, an exemplary installation of the remote plasma source 200 as part of a reactor 300 is discussed with respect to FIG. 8. Finally, performance results of the reactor 300 with the remote plasma source 200 is discussed with respect to FIGS. 9A through 14.

Figure 1A:
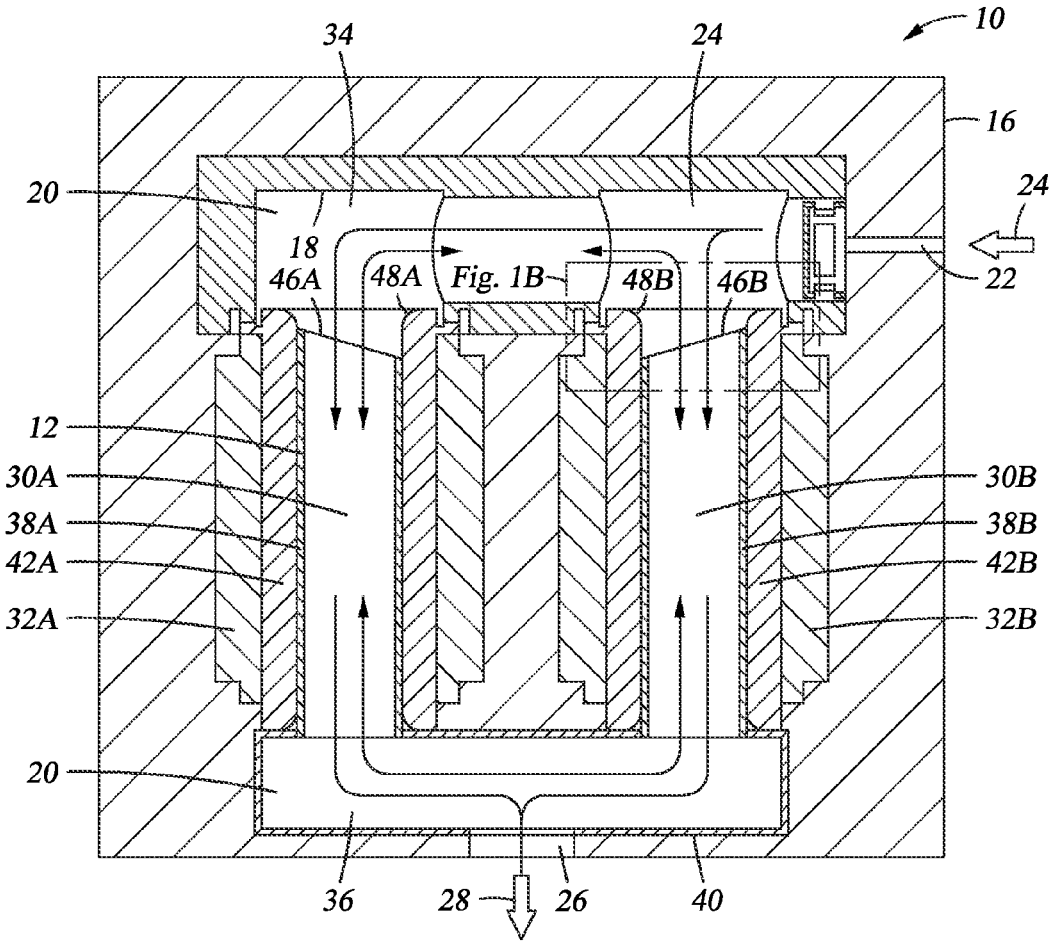
Fig. 1A (PRIOR ART)
FIGS. 1A and 1B are a sectional view and a close-up sectional view, respectively, of a conventional exemplary plasma generation system employing a conventional quartz liner as is known in the art within an enclosure assembly, the enclosure assembly comprising an internal enclosure surface forming enclosure passageway(s) delivering at least one precursor gas into the quartz liner.
Figure 1B:
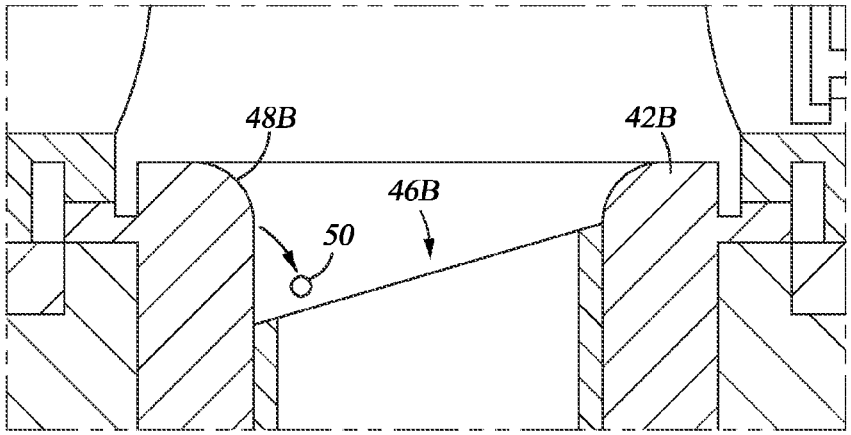
Fig. 1B (PRIOR ART)
Figure 1C:
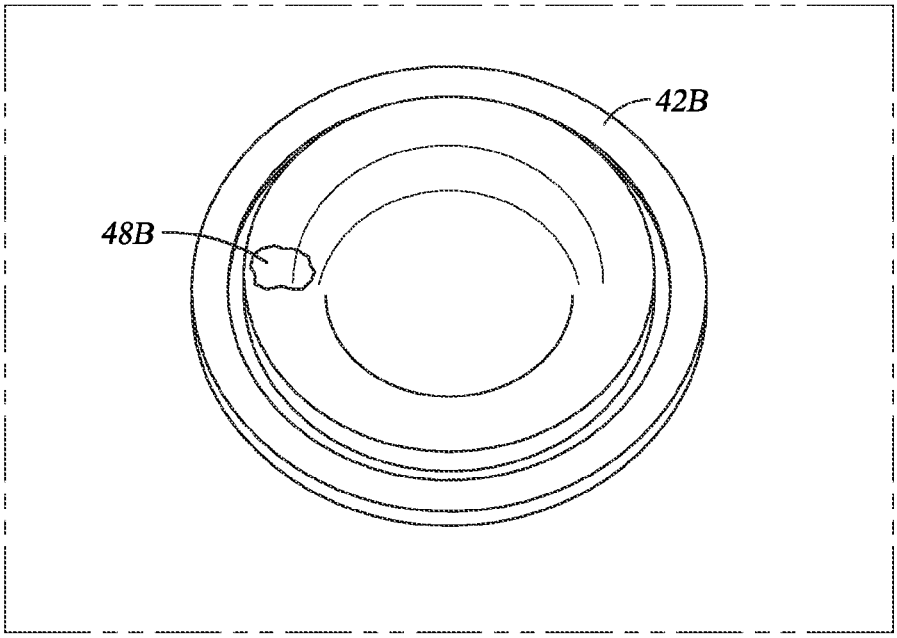
Fig. 1C (PRIOR ART)
FIG. 1C is a top perspective partial close-up view of a portion of enclosure passageway of the conventional plasma generation system of FIG. 1A leading to one of the parallel passageways with an erosion region disposed on the portion of the enclosure passageway as is known in the art.
Figure 2:
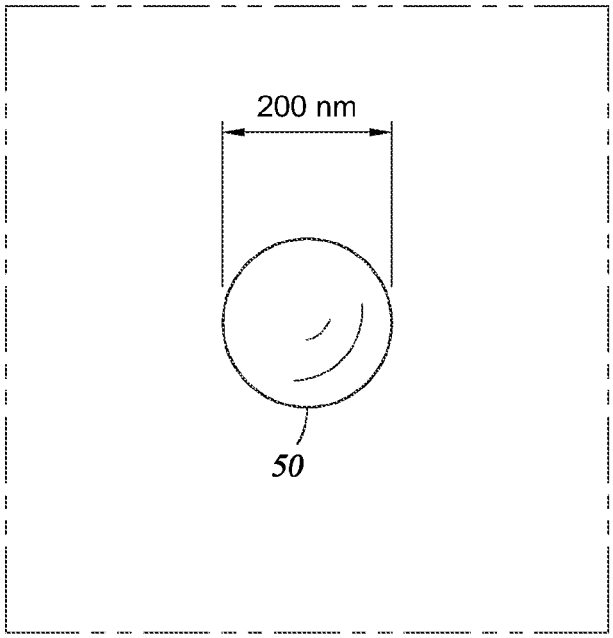
Fig. 2 (PRIOR ART)
FIG. 2 is a exemplary sub-micron particulate generated from the internal enclosure surface of FIG. 1A during the formation of the erosion region after exposure to the precursor gas and/or the plasma as is known in the art.

It is noted for purposes of clarity that the remote plasma source 200 of FIGS. 3A and 3B may be functionally similar to the conventional plasma generation system 10 of FIGS. 1A and 1B in the sense that the precursor gas 204 may be converted to the plasma 202 which may then be discharged. It is noted that many differences may be easily observed related to the dielectric conduit assembly 206 of the remote plasma source 200. However, a complete discussion of the different features of the remote plasma source 200 is provided herein below for thoroughness.

With continued reference to FIGS. 3A and 3B, the remote plasma source 200 includes an enclosure assembly 210 including an enclosure body 212 having multiple internal surfaces 214 forming an internal chamber 216. The enclosure body 212 provides the internal chamber 216 in which the at least one precursor gas 204 may be converted into the plasma 202. Due to the high energy of the plasma 202 and the desire to minimize the contamination-causing particulates 50, the enclosure body 212 may comprise high strength materials which exhibit resistance to high temperatures and particulate generation, for example, stainless steel or aluminum. In this manner, as energy 218 is added to the precursor gas 204 within the enclosure body 212 to generate the plasma 202, the plasma 202 generated may be contained safely within the enclosure body 212 while minimizing particulate generation.

The enclosure body 212 also includes an input port 220 to receive the precursor gas 204. The input port 220 is a controlled passageway into the enclosure body 212 and may interface with gas supply equipment (not shown) to deliver the precursor gas 204 from a gas source (not shown), for example, a gas panel. The precursor gas 204 may include one or more components, for example, oxygen (O2), nitrogen (N2), water vapor (H2O), ammonia (NH3), fluorine-containing gases, helium, and others. Once the precursor gas 204 has traveled through the input port 220 and into the internal chamber 216, the precursor gas 204 is available to receive energy to be converted into plasma 202.

With continued reference to FIGS. 3A and 3B, the enclosure body 212 also includes an output port 222 to discharge the plasma 202. The output port 222 is a different controlled passageway leading outside of the internal chamber 216 and may interface with plasma-consuming equipment, for example, as part of the reactor 300 (discussed later in FIG. 8). Due to the high energy and corrosive potential of various types of the plasma 202 which can be generated with the precursor gas 204, the output port 222 must safely allow the plasma 202 to depart from the internal chamber 216 without particulates which may potentially contaminate downstream workpieces, for example, silicon wafers being exposed to the plasma 202.

As described briefly earlier, the plasma 202 is generated within the internal chamber 216 by adding energy to the precursor gas 204 within the internal chamber 216. One or more energy sources 224(A), 224(B) may be used to add the energy 218 to the precursor gas 204 to produce the plasma 202. The energy sources 224(A), 224(B) may be proximate to and/or surround one or more energizing portions 226(A), 226(B) of the internal chamber 216 containing the precursor gas 204. In this manner, the energy may be more easily transferred to the precursor gas 204 to produce the plasma 202 in the energizing portions 226(A), 226(B). In the exemplary embodiment shown in FIGS. 3A through 3D, two energy sources 224(A), 224(B) may be ferrite cores configured to provide the energy 218 which may be, for example, radio frequency (RF) energy.

In order to have the flexibility to generate many types of the plasma 202, including those that may be highly corrosive to the internal surface 214 of the enclosure body 212, the remote plasma source 200 also includes the dielectric conduit assembly 206. The dielectric conduit assembly 206 is disposed within the internal chamber 216 and may guide the precursor gas 204 away from contact with the internal surface 214 of the enclosure body 212. The dielectric conduit assembly 206 may comprise at least one material having high temperature resistance and dielectric properties, for example quartz and/or yttria, which is highly resistant to corrosive effects of various types of the plasma 202.

The dielectric conduit assembly 206 may be positioned within the enclosure body 212 by interfacing with the internal surface 214 of the enclosure body 212. The dielectric conduit assembly 206 may be positioned by creating abutments 228 with the internal surface 214. The internal surface 214 of the enclosure body 212 may include one or more positioning sleeves 230(A), 230(B) in which also contribute a portion of the internal surface 214 upon which the dielectric conduit assembly 206 may form the abutments 228. The dielectric conduit assembly 206 may be vulnerable to damage, for example, cracking if the internal surface 214 abuts against the dielectric conduit assembly 206 too closely particularly during thermal cycling between room temperature and an operation temperature. Accordingly, at least one surface 215 of the internal surface 214 may be free of abutments 228 with the dielectric conduit assembly 206 in order to provide additional clearance to allow the dielectric conduit assembly 206 to more easily align itself within the enclosure body 212 and prevent damage to the dielectric conduit assembly 206 during operation.

With continued reference to FIGS. 3A and 3B, the dielectric conduit assembly 206 comprises a first cross-conduit segment 232, and a second cross-conduit segment 234 having two integral and parallel conduit segments 236(A), 236(B). By having the dielectric conduit assembly 206 comprising multiple removable segments, the dielectric conduit assembly 206 may be more easily de-installed and re-installed within the enclosure body 212 to allow convenient servicing while providing additional protection for the internal surface 214 from the plasma 202 and the precursor gas 204. Indeed, the remote plasma source 200 and the internal surface 214 of the enclosure body 212 may experience erosion and/or contamination during operation as a result of being exposed to the plasma 202 and the precursor gas 204. In this manner, parts of the dielectric conduit assembly 206 containing segments may no longer be in a usable state because of erosion and/or contamination issues and may be replaced or otherwise be efficiently made serviceable while one or more different segments not needing extensive repairs can be reused.

Now that the general overall operation of the dielectric conduit assembly 206 within the enclosure body 212 has been introduced, the contribution of each of the segments of the dielectric conduit assembly 206 will be sequentially discussed.

The first cross-conduit segment 232 may be disposed within the internal chamber 216 of the enclosure body 212 and the first cross-conduit segment 232 encloses a first passageway 238 in communication with the input port 220. The first cross-conduit segment 232 may include a first inner surface 240 forming the first passageway 238. In this manner, the first cross-conduit segment 232 may be configured to be disposed between the precursor gas 204 and the internal surface 214 of the enclosure body 212 and guide the precursor gas 204 away from the internal surface 214. The first cross-conduit segment 232 may be in communication with the plurality of parallel conduit segments 236(A), 236(B) where the precursor gas 204 may be exposed to the energy 218 to generate the plasma 202. Details of an interface between the parallel conduit segments 236(A), 236(B) and the first cross-conduit segment 232 are discussed in detail later with reference to FIGS. 3C and 3D, after the other segments of the dielectric conduit assembly 206 are introduced.

With continued reference to FIGS. 3A and 3B, the second cross-conduit segment 234 may also be disposed within the internal chamber 216 of the enclosure body 212 and the second cross-conduit segment 234 encloses a second passageway 242 in communication with the output port 222. It is noted that the second cross-conduit segment 234 may include an output orifice 221 which allows passage of the plasma 202 from the second passageway 242 to the output port 222. The second cross-conduit segment 234 may include a second inner surface 244 forming the second passageway 242. In this manner, the second cross-conduit segment 234 may be configured to be disposed between the plasma 202 and the internal surface 214 of the enclosure body 212 and guide the plasma 202 away from the internal surface 214. The second cross-conduit segment 234 may be in communication with the plurality of parallel conduit segments 236(A), 236(B) where the plasma 202 may be generated.

The plurality of parallel conduit segments 236(A), 236(B) may be disposed within the internal chamber 216 of the enclosure body 212 and the parallel conduit segments 236(A), 236(B) encloses inner spaces 246(A), 246(B) in communication with both the first passageway 238 and the second passageway 242. The parallel conduit segments 236(A), 236(B) may extend from the second cross-conduit segment 234 to distal ends 245(A), 245(B), respectively, to receive the precursor gas 204 at removable interfaces 247(A), 247(B) from the first passageway 238 of the first cross-conduit segment 232. The first cross-conduit segment 232 comprises at least two openings 243(A), 243(B) for removably receiving the distal ends 245(A), 245(B) of the parallel conduit segments 236(A), 236(B). In contrast, the parallel conduit segments 236(A), 236(B) may be integral with the second cross-conduit segment 234 to better isolate the plasma 202 from the internal surface 214 as the plasma 202 exits the inner spaces 246(A), 246(B) of the parallel conduit segments 236(A), 236(B) and enters the second passageway 242 of the second cross-conduit segment 234. Another advantage of having the parallel conduit segments 236(A), 236(B) integral with the second cross-conduit segment 232 may that given some vertical orientations of the remote plasma source 200, the particulates 50 generated between the positioning sleeves 230 (A), 230(B) and the parallel conduit segments 236(A), 236 (B) may be less likely to enter the second passageway 242. In this way the inner spaces 246(A), 246(B) may receive the precursor gas 204 from the first passageway 238 and transfer the plasma 202 generated within the inner spaces 246(A), 246(B) to the second passageway 242.

Moreover, the parallel conduit segments 236(A), 236(B) may include third inner surfaces 248(A), 248(B) forming the inner spaces 246(A), 246(B). In this manner, the inner spaces 246(A), 246(B) may be configured to be disposed between the plasma 202 and the internal surface 214 of the enclosure body 212 and guide the plasma 202 away from the internal surface 214. It is noted that the exemplary embodiment shown in FIG. 3B depicts a quantity two (2) of the parallel conduit segments 236(A), 236(B), but more than two (2) are also possible in other embodiments (not shown).

Figure 3C:
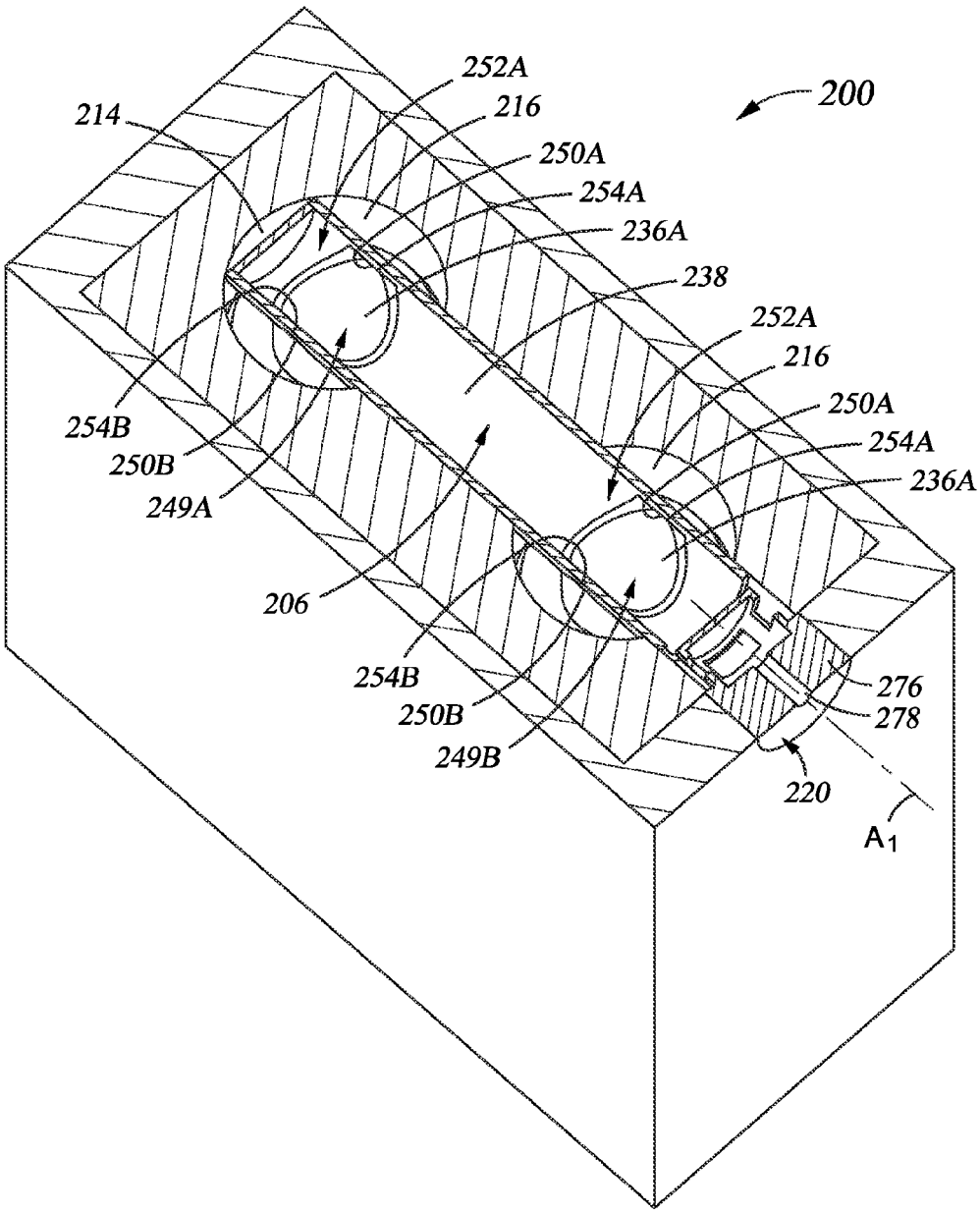
Figure 3D:
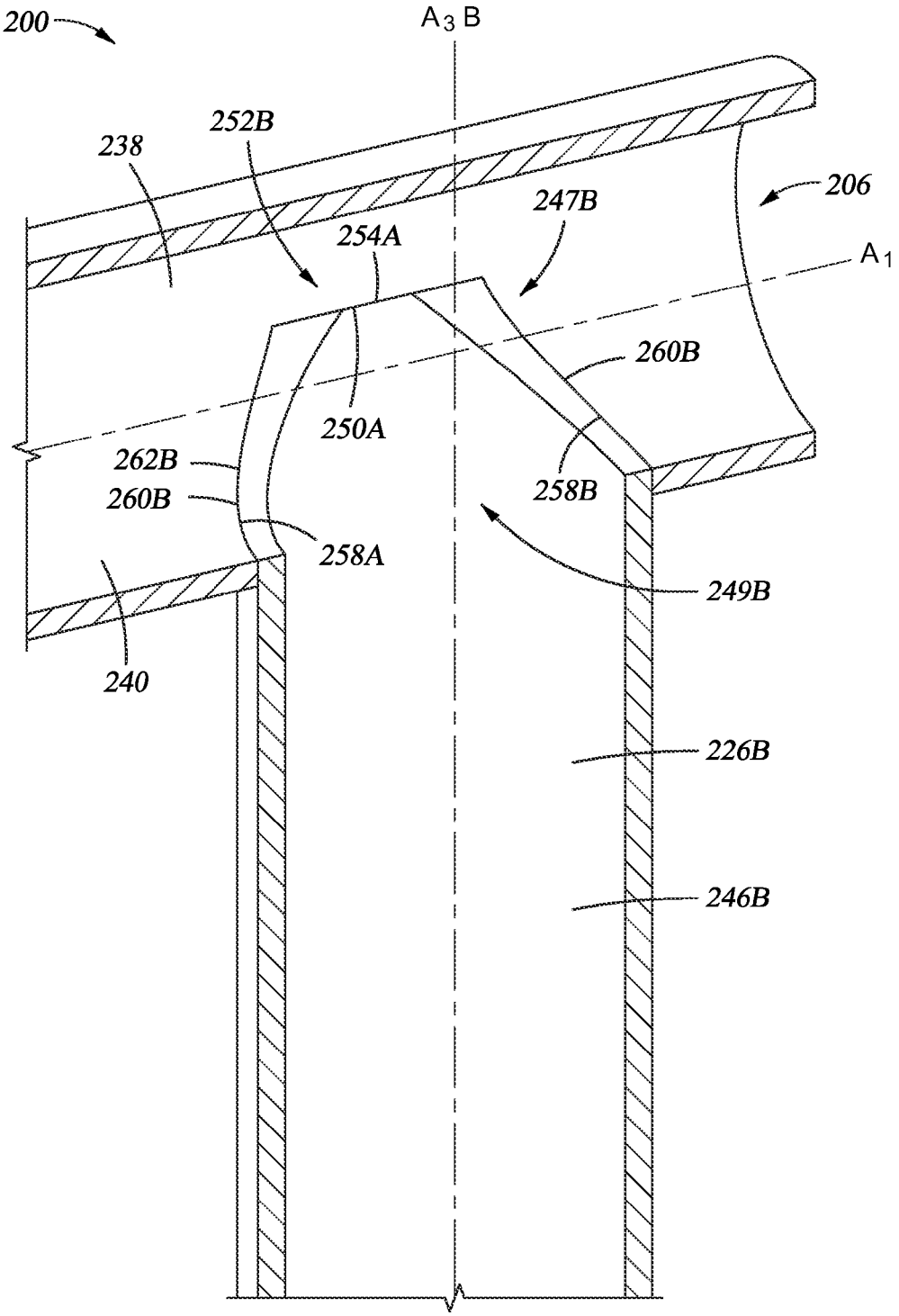

FIGS. 3C and 3D depict the removable interfaces 247(A), 247(B) of the dielectric conduit assembly 206 to facilitate the easy assembly and disassembly of the dielectric conduit assembly 206 within the enclosure body 212. In this regard, the first cross-conduit segment 232 further comprises a plurality of first surfaces 249(A), 249(B) forming the plurality of openings 243(A), 243(B), respectively, of the first cross-conduit segment 232. Each of the plurality of first surfaces 249 (A), 249(B) comprising two first coplanar surfaces 250A, 250B parallel or substantially parallel to a longitudinal axis $A_1$ of the first cross-conduit segment 232. In this manner, the two first coplanar surfaces 250A, 250B may be configured to form a removable interface.

The distal ends 245(A), 245(B) of the parallel conduit segments 236(A), 236(B) may be used to support the first cross-conduit segment 232 and form the removable interface. Specifically, each of the distal ends 245(A), 245(B) of the parallel conduit segments 236(A), 236(B) may be formed by a plurality of secondary surfaces 252(A), 252(B). Each of the secondary surfaces 252(A), 252(B) comprising two secondary coplanar surfaces 254A, 254B angled to a respective one of longitudinal axes $A_3$(A), $A_3$(B) of each the parallel conduit segments 236(A), 236(B). In this manner, the two secondary coplanar surfaces 254A, 254B may be used to abut against the two first coplanar surfaces 250A, 250B of the first cross-conduit segment 232 to support the first cross-conduit segment 232.

Moreover, with continued reference to FIGS. 3C and 3D, each of the secondary surfaces 252(A), 252(B) of the parallel conduit segments 236(A), 236(B) may be positioned to avoid obstructing a flow of precursor gas 204 to the inner spaces 256(A), 246(B) of the parallel conduit segments 236(A), 236(B). In this regard, the secondary surfaces 252(A), 252(B) of each of the distal ends 245(A), 245(B) of the parallel conduit segments 236(A), 236(B) may further comprises two contoured medial surfaces 256A, 256B connecting the two secondary coplanar surfaces 254A, 254B (see also FIG. 4I). The two contoured medial surfaces 256A, 256B may be disposed to follow a shape of the first inner surface 240 of the first cross-conduit segment 232 when the two secondary coplanar surfaces 254A, 254B support the two first coplanar surfaces 250A, 250B. The shape may be, for example, that of a circular cylinder. In this manner, the flow of the precursor gas 204 in the first passageway 238 of the first cross-conduit segment 232 may be free of obstruction.

Further, each the first surfaces 249(A), 249(B) of the first cross-conduit segment 232 may be positioned to reduce exposure of the internal surface 214 to the plasma 202 and/or the precursor gas 204 which may damage the internal surface 214 and generate the particulates 50. In this regard, each of the first surfaces 249(A), 249(B) further comprises two first medial surfaces 258A, 258B. Each of the two first medial surfaces 258A, 258B may connect ends of the two first coplanar surfaces 250A, 250B and are disposed to follow a shape of external surfaces 260(A), 260(B) of a respective one of the parallel conduit segments 236(A), 236(B) when the two secondary coplanar surfaces 254A, 254B support the two first coplanar surfaces 250A, 250B. Gaps 262(A), 262(B) may be formed between the two first medial surfaces 258A, 258B and the external surfaces 260(A), 260(B) may be in a range up to, for example, five-hundred (500) microns. In this way, each the first surfaces 249(A), 249(B) of the first cross-conduit segment 232 may be positioned to reduce exposure of the internal surface 214 to the plasma 202 and/or the precursor gas 204 which may damage the internal surface 214 of the enclosure body 212 and generate the particulates 50. It is also noted that if the gaps 262(A), 262(B) may be formed with vertical orientations, then gravity may further reduce the probability that particulates 50 generated at the internal surface 214 of the enclosure body 212 would travel up through the gaps 262(A), 262(B) to enter the inner space 246(A), 246(B) and cause contamination.

Now that the dielectric conduit assembly 206 has been introduced in relation to its functionality the remote plasma source 200, details of the dielectric conduit assembly 206 are now provided. In this regard, FIGS. 4A through 4I are perspective, left side, front side, back side, back sectional, top side, bottom side, side cross-sectional, and exploded views, respectively, of the dielectric conduit assembly of FIG. 3B comprising the first cross-conduit segment 232, the parallel conduit segments 236(A), 236(B), and the second cross-conduit segment 234.

The first cross-conduit segment 232 may comprise a cylindrical shape with a uniform or substantially uniform thickness. In this manner, the first cross-conduit segment 232 may be slid along its longitudinal axis $A_1$ into the enclosure body 212 (see FIG. 6). The first cross-conduit segment 232 may extend from a first side 264 to a second side 266 along the longitudinal axis $A_1$ of the first cross-conduit segment 232. The first side 264 may include an opening 268 to allow the precursor gas 204 to enter the first passageway 238 from the input port 220 of the enclosure body 212. The second side 266 may be closed to facilitate a flow of precursor gas 204 to the inner spaces 246(A), 246(B) of the parallel conduit segments 236(A), 236(B) and to guide the precursor gas 204 and/or plasma 202 away from the internal surface 214 of the enclosure body 212.

Figure 4A:
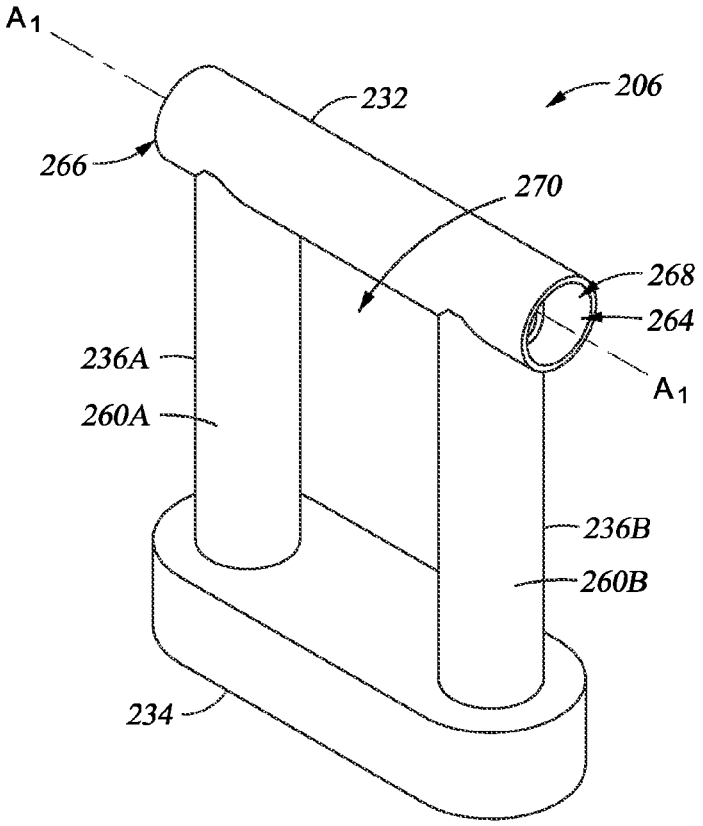
FIGS. 4A through 4I are perspective, left side, front side, back side, back sectional, top side, bottom side, right side sectional, and right side exploded views, respectively, of the dielectric conduit assembly of FIG. 3B comprising the first cross-conduit segment, the plurality of parallel conduit segments, and a second cross-conduit segment for providing ease of maintenance and reduction of particulate generation within the remote plasma source.
Figure 4B:
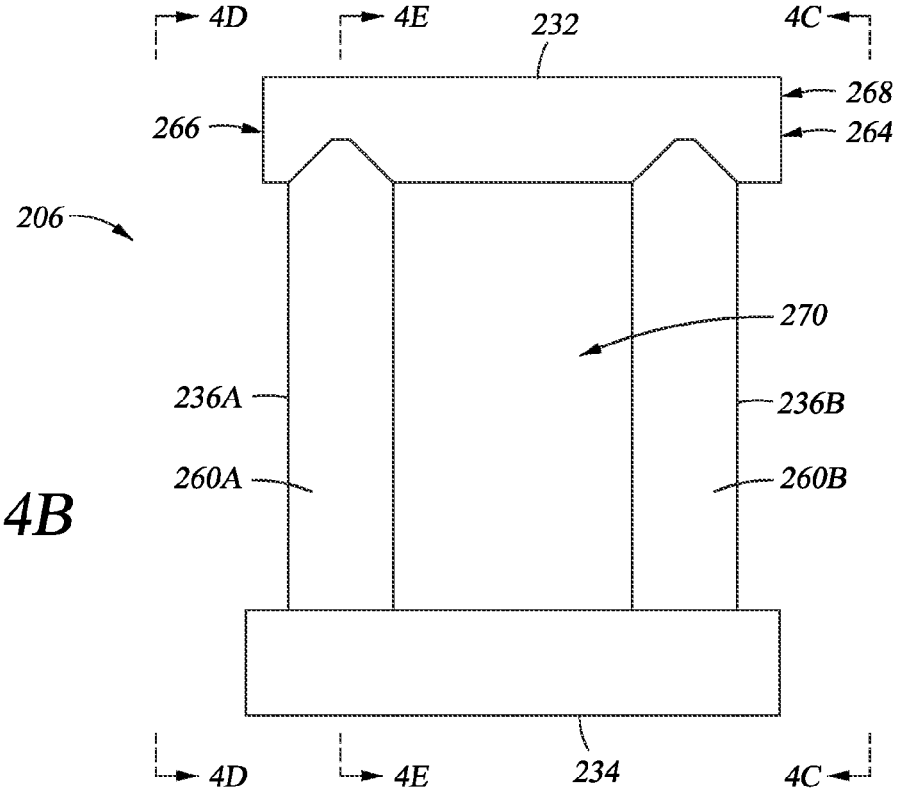
Figure 4E:
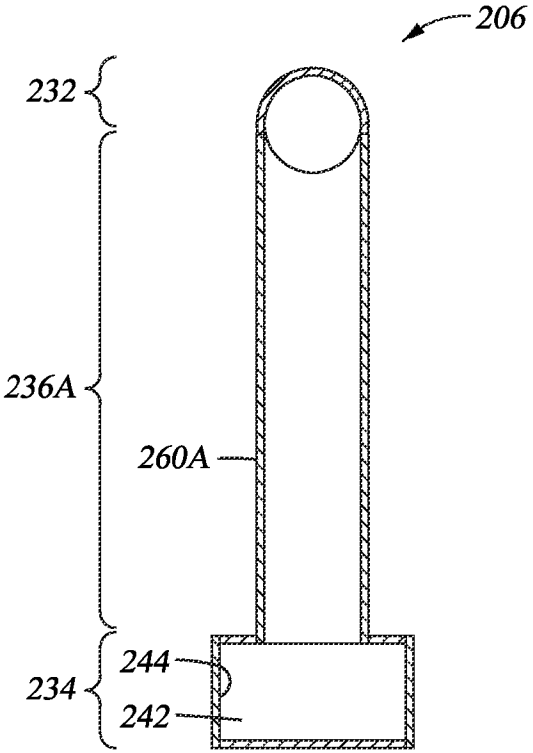
Figure 4D:
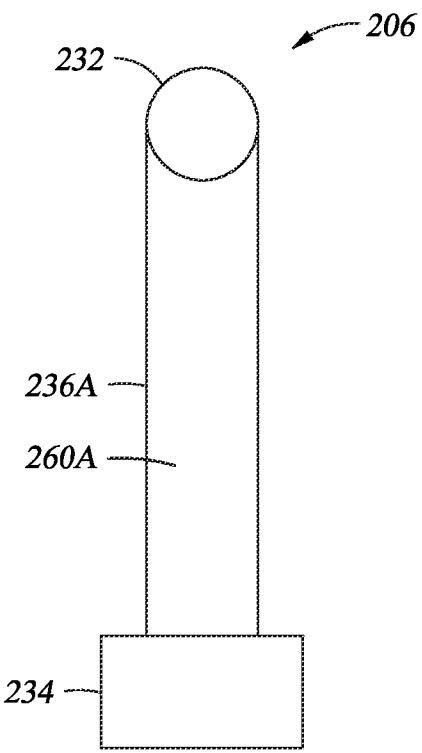
Figure 4C:
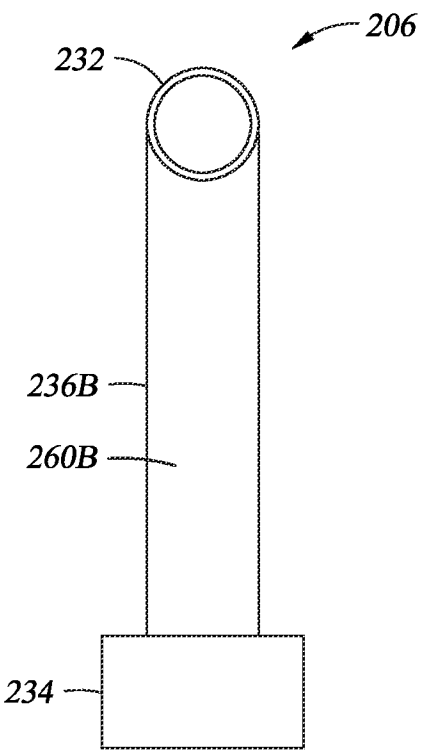
Figure 4H:
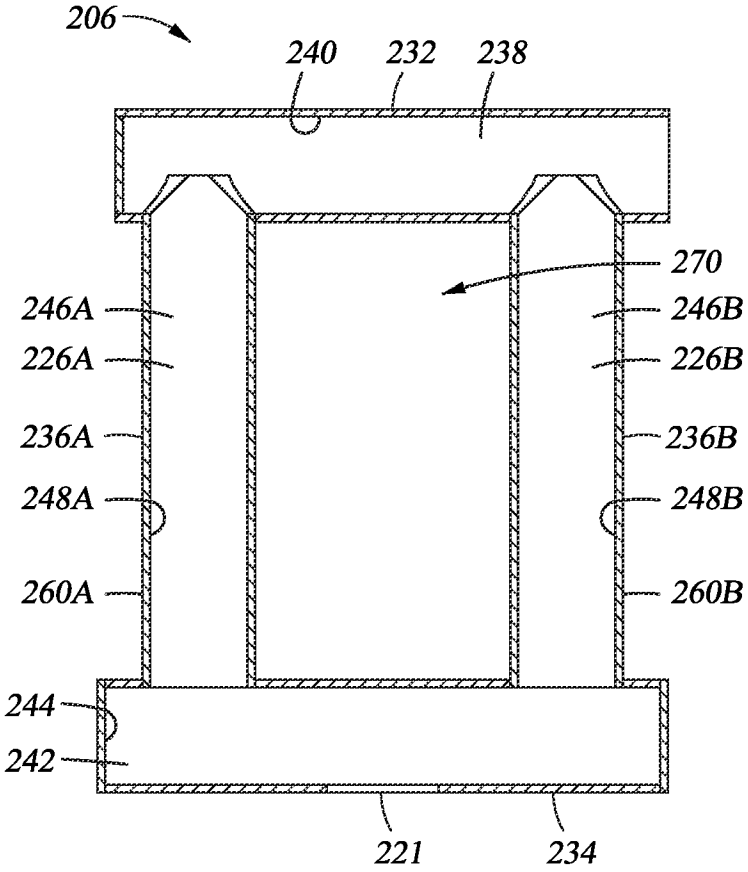
Figure 4F:
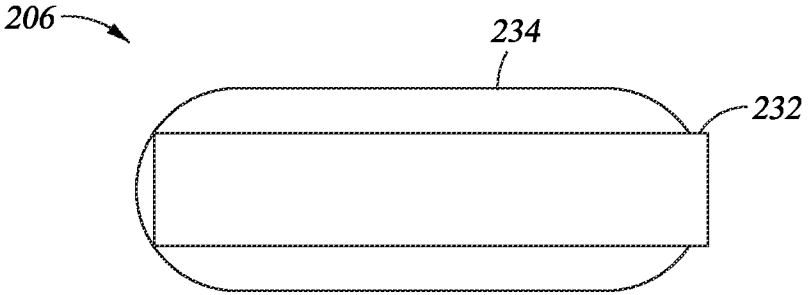
Figure 4G:
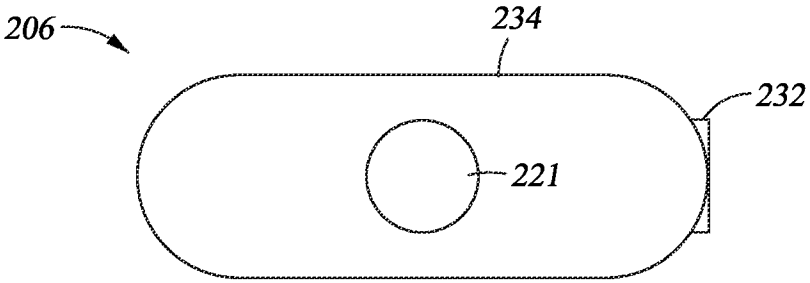
Figure 4I:
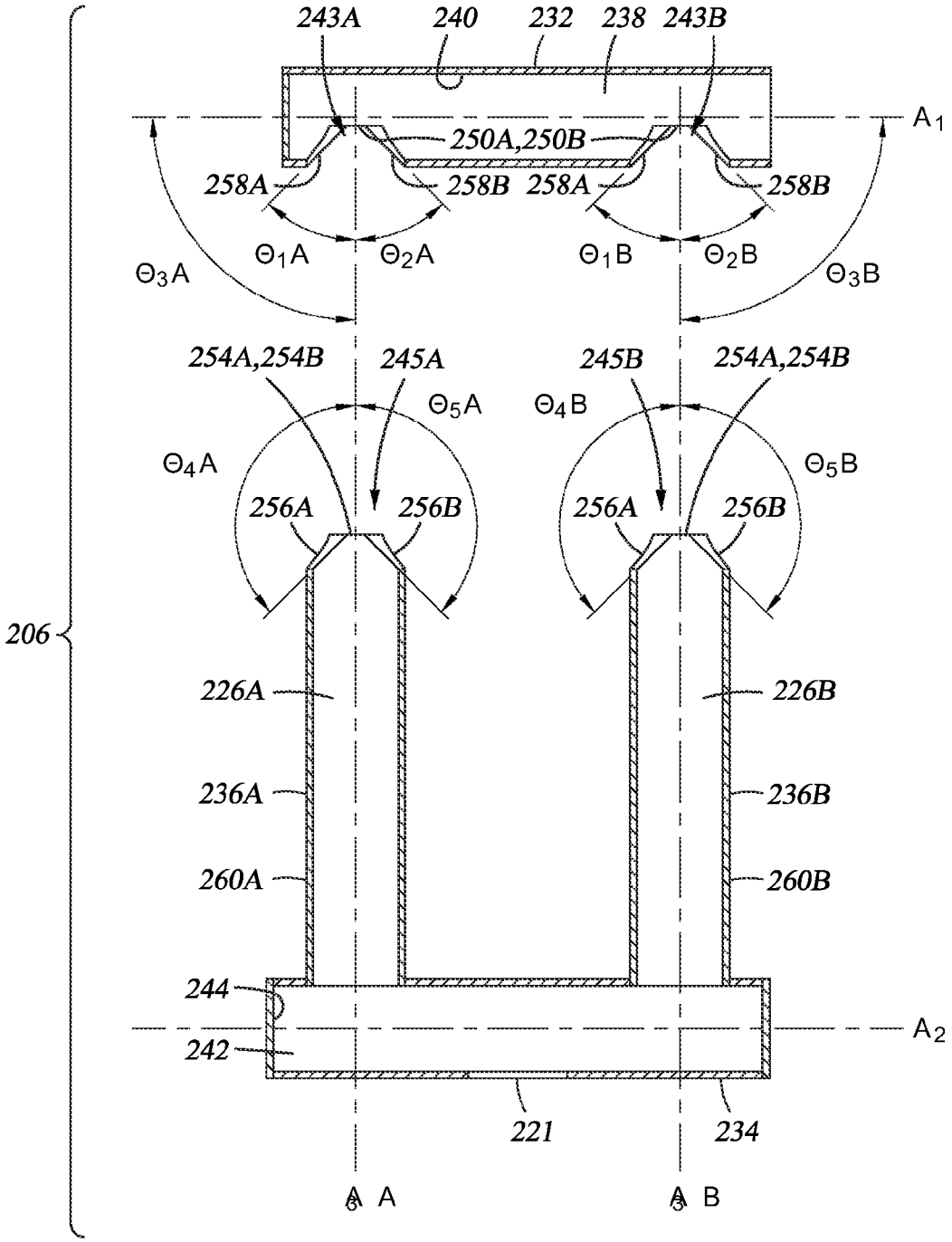

With continued reference to FIGS. 4A through 4I, the parallel conduit segments 236(A), 236(B) may interface with the first cross-conduit segment 232 so that the longitudinal axes $A_3$(A), $A_3$(B) of the parallel conduit segments 236(A), 236(B), respectively, may be orthogonal or substantially orthogonal with the longitudinal axis $A_1$ of the first cross-conduit segment 232 as depicted by $\theta_3$ in FIG. 4I. In this manner, a space 270 between the parallel conduit segments 236(A), 236(B) is maximized to efficiently accommodate the energy sources 224(A), 224(B) (FIG. 3B).

With reference to FIG. 4I, it is noted that the gaps 262(A), 262(B) may be adjusted by changing angular relationships at the openings 243(A), 243(B), respectively, of the first cross-conduit segment 232 and the distal ends 245(A), 245(B) of the parallel conduit segments 236(A), 236(B). In this regard, an angle $\theta_1$ and $\theta_2$ positioning the two first medial surfaces 258A, 258B, respectively, of the first cross-conduit segment 232 may be, for example, forty-five (45) degrees from the longitudinal axes $A_3$(A), $A_3$(B) when the dielectric conduit assembly 206 is installed. Further, an angle $\theta_4$ and angle $\theta_5$ measuring the two contoured medial surfaces 256A, 256B, respectively, of the parallel conduit segments 236(A), 236(B) may be, for example, one-hundred thirty-five (135) degrees from the longitudinal axes $A_3$(A), $A_3$(B). In this manner, the gaps 262(A), 262(B) may be minimized and the internal surface 214 of the enclosure body 212 better protected against the precursor gas 204 and/or the plasma 202.

Now that details of the dielectric conduit assembly 206 have been discussed, an exemplary method 272 for installing the dielectric conduit assembly 206 into the enclosure body 212 of the remote plasma source 200 will now be discussed. In this regard, FIG. 5 is a flowchart of the exemplary method 272 and will be discussed using the terminology discussed above relative to FIGS. 6-7.

Figure 5:
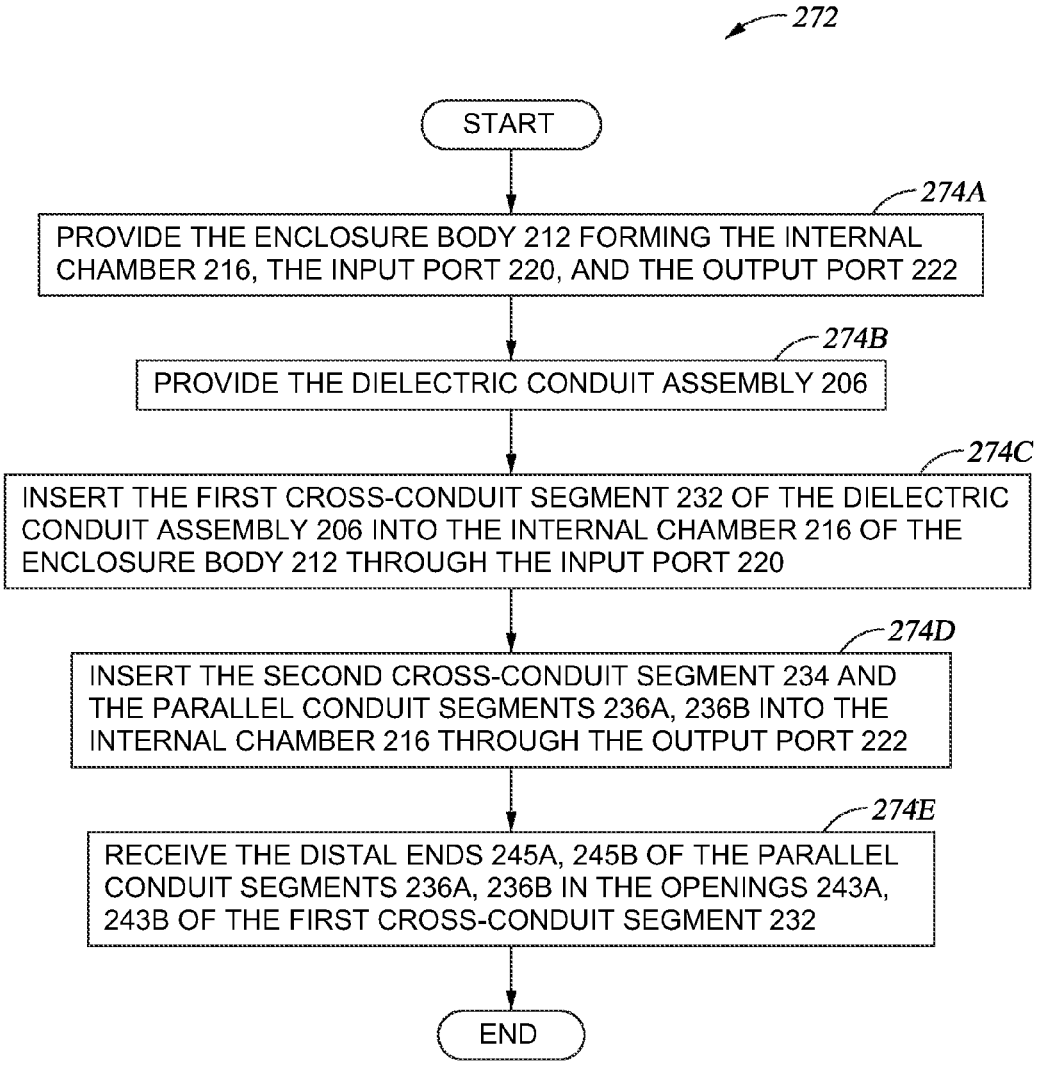
FIG. 5 is a flowchart of an exemplary method for installing the dielectric conduit assembly into the enclosure body of the remote plasma source facilitating an aspect of ease of maintenance.
Figure 6:
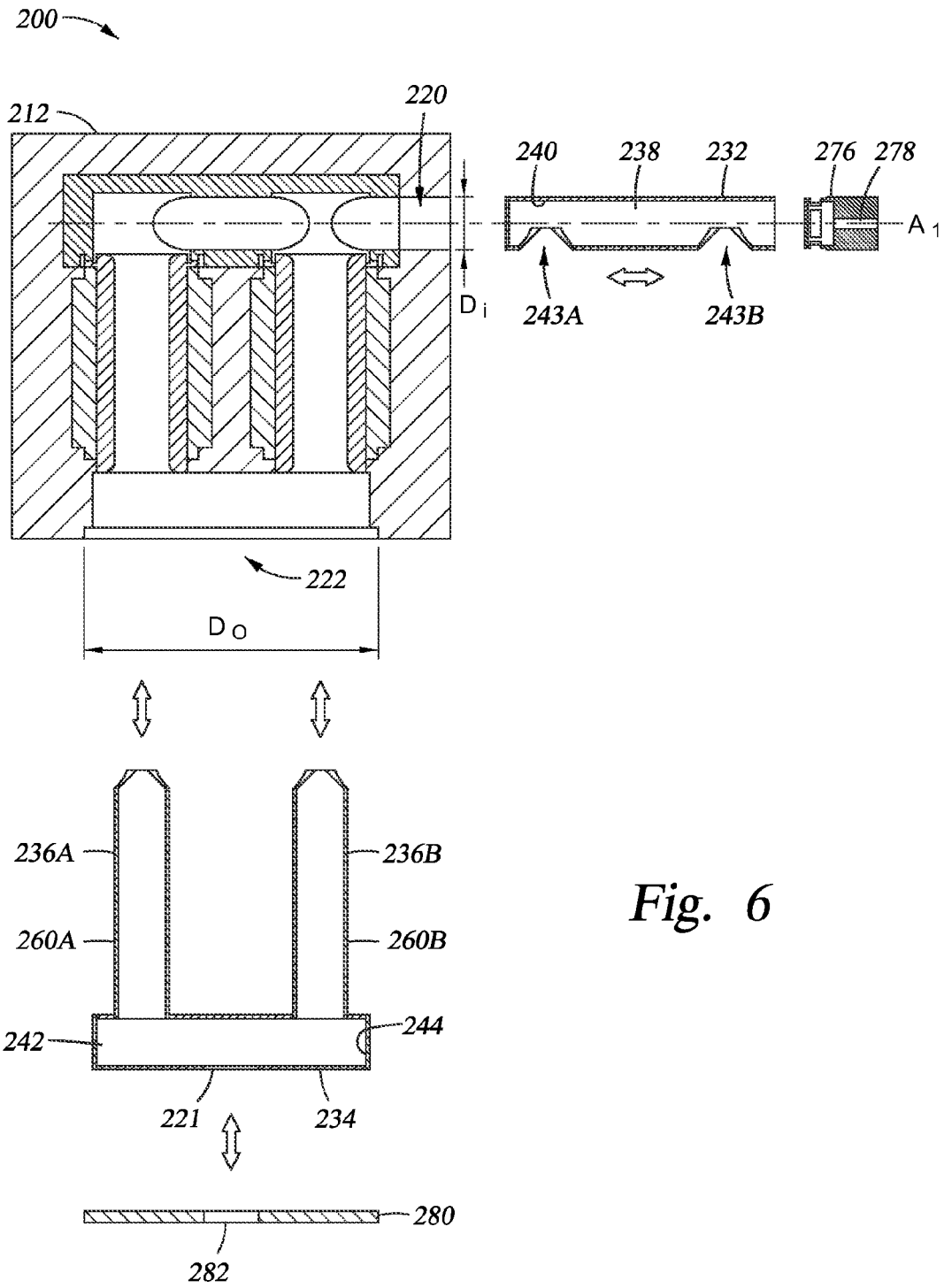
FIG. 6 is an exploded left side cross-sectional view of the plasma generation system of FIG. 3B depicting the dielectric conduit assembly being installed into the enclosure body of the assembly illustrating one aspect of ease of maintenance of the dielectric conduit assembly including a removable plug which may be removable from the input port of the enclosure body to enable the first cross-conduit segment to be installed or de-installed in to the enclosure body.

In this regard, the method 272 may include providing the enclosure body 212 forming the internal chamber 216, the input port 220, and the output port 222 (operation 274A of FIG. 5). The method 272 may also include providing the dielectric conduit assembly 206 (operation 274B of FIG. 5). The dielectric conduit assembly 206 may include the first cross-conduit segment 232 enclosing the first passageway 238. The dielectric conduit assembly 206 may also include the second cross-conduit segment 234 enclosing the second passageway 242. The dielectric conduit assembly 206 may also include the at least two parallel conduit segments 236(A), 236(B) extending from the second cross-conduit segment 234 to the distal ends 245(A), 245(B). The parallel conduit segments 236(A), 236(B) enclosing the inner spaces 246(A), 246(B), respectively, may be configured to communicate with the second passageway 242. The first cross-conduit segment 232 may include the openings 243(A), 243(B) for receiving the distal ends 245(A), 245(B) of the parallel conduit segments 236(A), 236(B). In this manner, the enclosure body 212 may be prepared for the dielectric conduit assembly 206 installation.

In order to protect the enclosure body 212 from the precursor gas 204 and/or the plasma 202 generated from the precursor gas 204 therein, the dielectric conduit assembly 206 may be disposed in the enclosure body 212. The method 272 may also include inserting the first cross-conduit segment 232 of the dielectric conduit assembly 206 into the internal chamber 216 of the enclosure body 212 through the input port 220 (operation 274C of FIG. 5). The method 272 may also include inserting the second cross-conduit segment 234 and the parallel conduit segments 236(A), 236(B) into the internal chamber 216 through the output port 222 (operation 274D of FIG. 5). The method 272 may also include receiving the distal ends 245(A), 245(B) of the parallel conduit segments 236(A), 236(B) in the openings 243(A), 243(B) of the first cross-conduit segment 232 (operation 274E of FIG. 5). Once the dielectric conduit assembly 206 is installed within the enclosure body 212, a removable input plug 276 may be received by the input port 220. The removable input plug 276 may include an input passageway 278 for guiding the precursor gas 204 through the input port 220. The input port 220 may include a dimension Di allowing for insertion and removal of the first cross-conduit segment 232 therethrough. It is also noted that a removable output plug 280 may be received by the output port 222. The removable output plug 280 may include an output passageway 282 for guiding the plasma 202 through the output port 222. The output port 222 may include a dimension Do allowing for insertion and removal of the second cross-conduit segment 234 and the parallel conduit segments 236(A), 236(B) therethrough. The removable output plug 280 (FIGS. 6 and 7) may be used to support the dielectric conduit assembly 206 and/or better seal the enclosure body 212. In this way, the dielectric conduit assembly 206 may be installed into the enclosure body 212 of the remote plasma source 200, and the enclosure body 212 may be configured to receive the precursor gas 204 and discharge the plasma 202.

Figure 8:
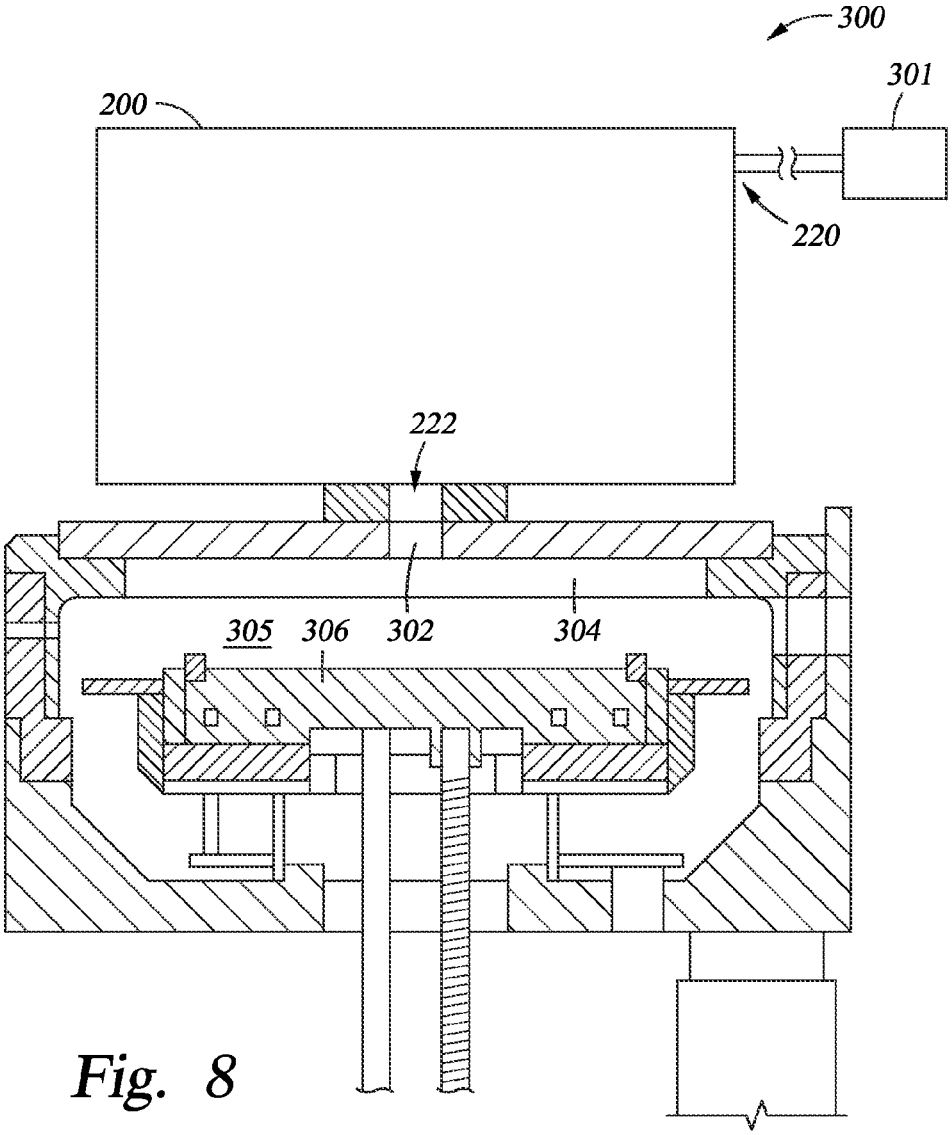
FIG. 8 is a schematic view of an exemplary etch system including the plasma generation source depicted in FIG. 3B and an exemplary reactor depicting one exemplary installation of the plasma generation system.

Now that an exemplary method 272 has been introduced to install the dielectric conduit assembly 206 into the enclosure body 212 of the remote plasma source 200, FIG. 8 depicts the remote plasma source 200 being utilized as part of an exemplary reactor 300. The plasma 202 may be generated in the remote plasma source 200 from the precursor gas 204 delivered to the remote plasma source 200 from a gas source 301 through the input port 220. The plasma 202 generated in the remote plasma source 200 flows through the output port 222 and into an exit tube 302 leading into a gas distribution plenum 304 for later introduction into a processing chamber 305. A substrate support 306 may be used to support a workpiece (not shown) which may be exposed to the plasma 202. In this manner, the remote plasma source 200 employing the dielectric conduit assembly 206 may be used as part of the reactor 300.

Now that the remote plasma source 200 employing the dielectric conduit assembly 206 has been introduced as part of the reactor 300, FIGS. 9A through 14 depict performance comparison results. The results are based on workpieces exposed to plasma within the reactor 300 and supplied by either the remote plasma source 200 of FIG. 3C employing the dielectric conduit assembly 206 or the conventional plasma generation system 10 of FIG. 1A employing the conventional quartz liner 12.

Figure 7:
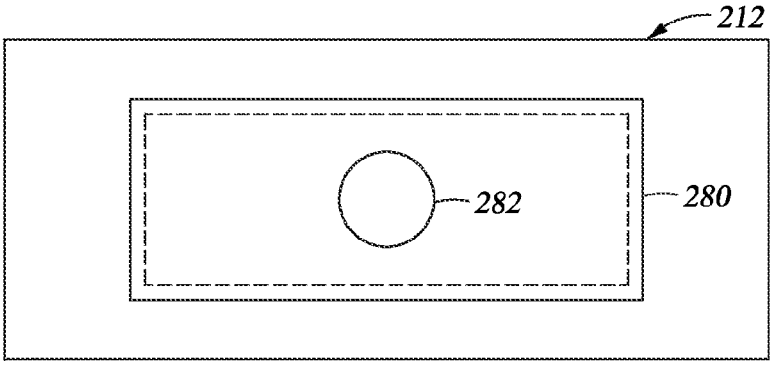
FIG. 7 is a bottom view of the of the enclosure assembly of FIG. 6 showing a removable output plug which may be removable from the output port of the enclosure body to allow the second cross-conduit segment and the plurality of parallel conduit segments and the second cross-conduit segment to be installed and removed.
Figure 9A:
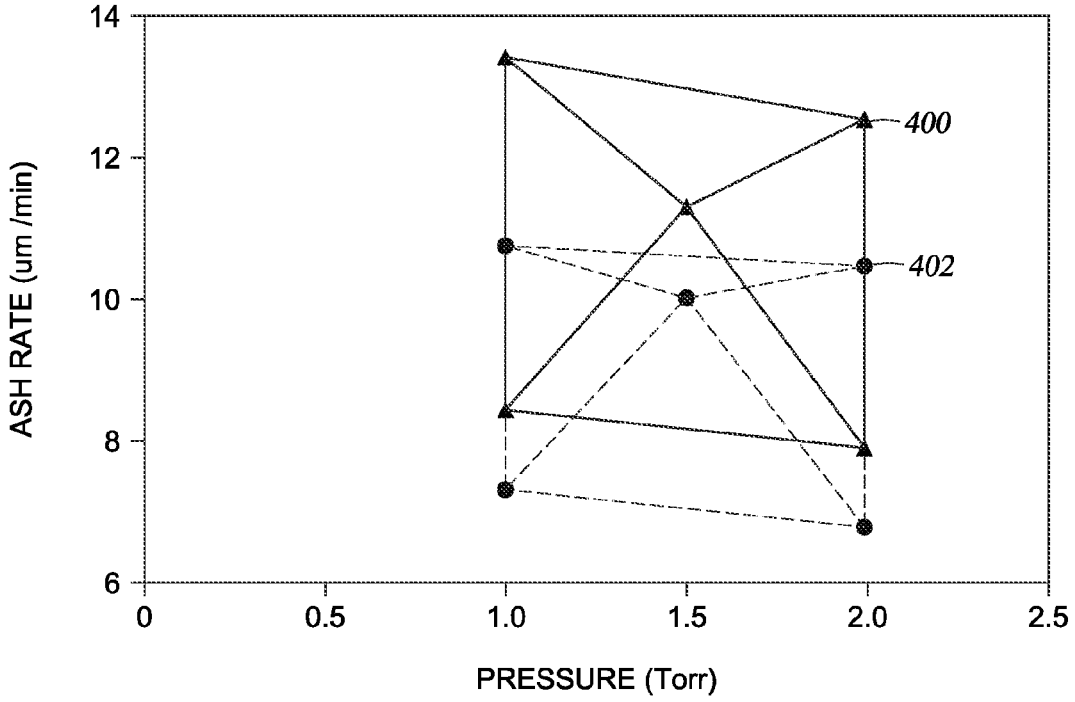
FIG. 9A is a process diagram of ash rate versus chamber pressure with a O2/N2 plasma composition illustrating an improved ash rate for the remote plasma source depicted in FIG. 3B versus results provided by the conventional plasma source of FIG. 1A.
Figure 9B:
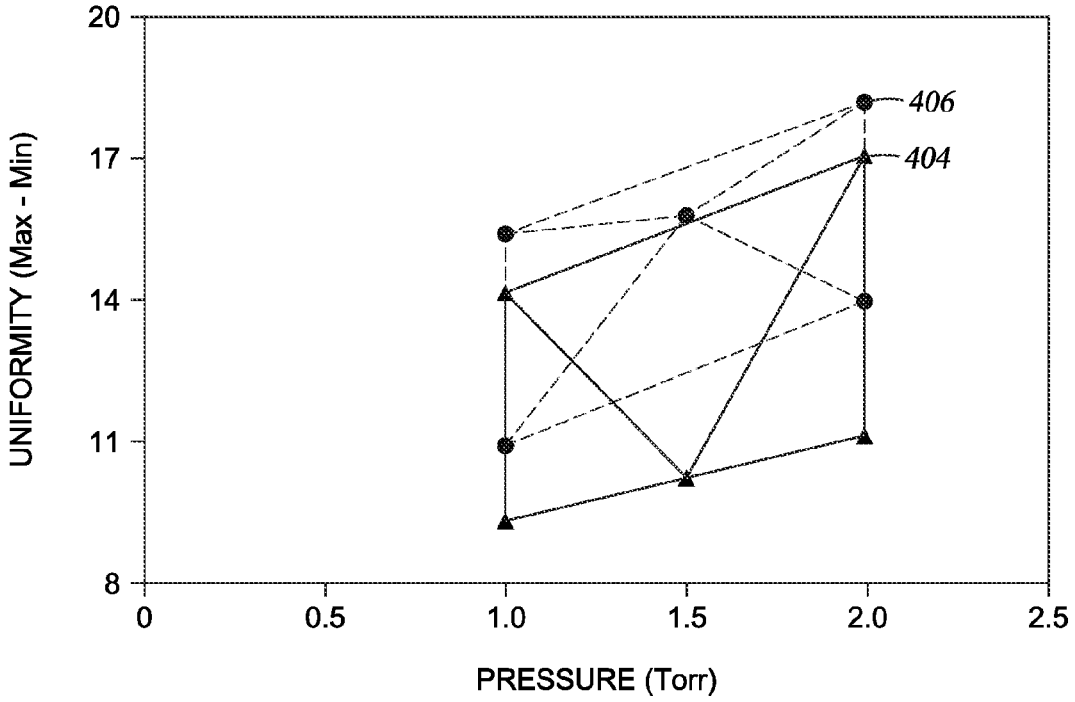
FIG. 9B is a process diagram of uniformity versus chamber pressure with the O2/N2 plasma composition illustrating improved uniformity the remote plasma source depicted in FIG. 3B versus results provided by the conventional plasma source of FIG. 1A.

FIG. 9A is a process diagram of ash rate versus chamber pressure depicting an improved ash rate for the remote plasma source 200 in comparison to that of the conventional plasma generation system 10 when alternatively installed as part of the reactor of FIG. 7 using O2/N2 plasma. Ashing rate results 400 using the remote plasma source 200 employing the dielectric conduit assembly 206 are twenty (20) to thirty (30) percent better than comparable ashing rate results 402 of the conventional plasma generation system 10. Moreover, FIG. 9B shows that uniformity error is improved roughly two (2) to four (4) percent for uniformity results 404 using the remote plasma source 200 employing the dielectric conduit assembly 206 compared to greater uniformity error results 406 of the conventional remote plasma source 12. Accordingly, although the remote plasma source 200 employing the dielectric conduit assembly 206 may have had a primary objective of reducing generation of the particulates 50, there are also measurable secondary benefits related to improving ashing rates and uniformity when using O2/N2 plasma.

Figure 10A:
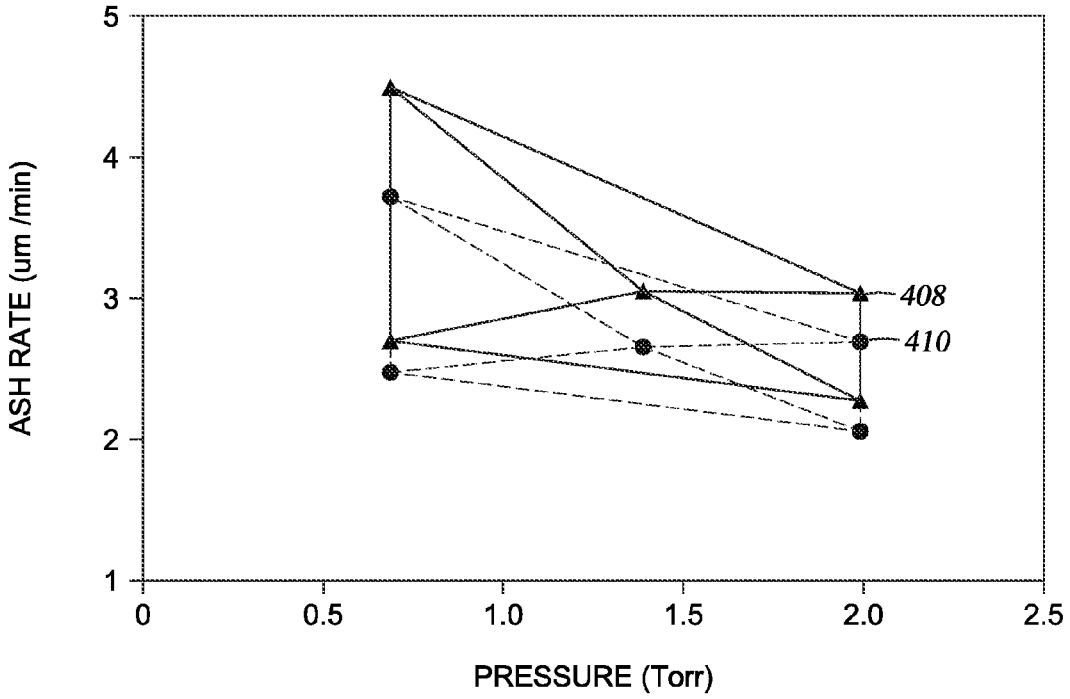
FIG. 10A is a process diagram of ash rate versus chamber pressure with a H2O plasma composition illustrating an improved ash rate for the remote plasma source depicted in FIG. 3B versus results provided by the conventional plasma source of FIG. 1A.
Figure 10B:
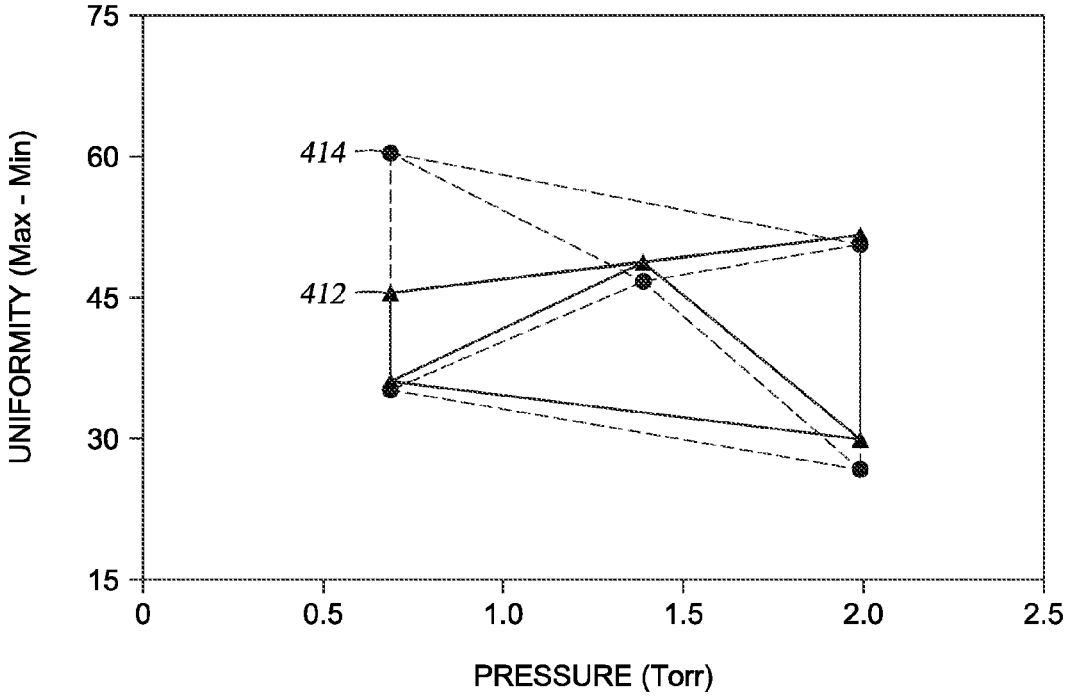
FIG. 10B is a process diagram of uniformity versus chamber pressure with the H2O plasma composition illustrating improved uniformity the remote plasma source depicted in FIG. 3B versus results provided by the conventional plasma source of FIG. 1A.

FIG. 10A is a process diagram of ash rate versus chamber pressure depicting an improved ash rate for the remote plasma source 200 in comparison to that of the conventional remote plasma system 10 when alternatively installed as part of the reactor of FIG. 7 using H2O plasma. Ashing rate results 408 using the remote plasma source 200 employing the dielectric conduit assembly 206 are fifteen (15) to twenty (20) percent better than comparable ashing rate results 410 of the conventional remote plasma source 12. Moreover, FIG. 10B shows that uniformity error is similar and/or improved for some data points for uniformity results 412 using the remote plasma source 200 employing the dielectric conduit assembly 206 compared to uniformity error results 414 provided by the conventional remote plasma source 12. Accordingly, although the remote plasma source 200 employing the dielectric conduit assembly 206 may have had a primary objective of reducing generation of the particulates 50, there are also measurable secondary benefits related to improving ashing rates and uniformity when using H2O plasma.

Figure 11A:
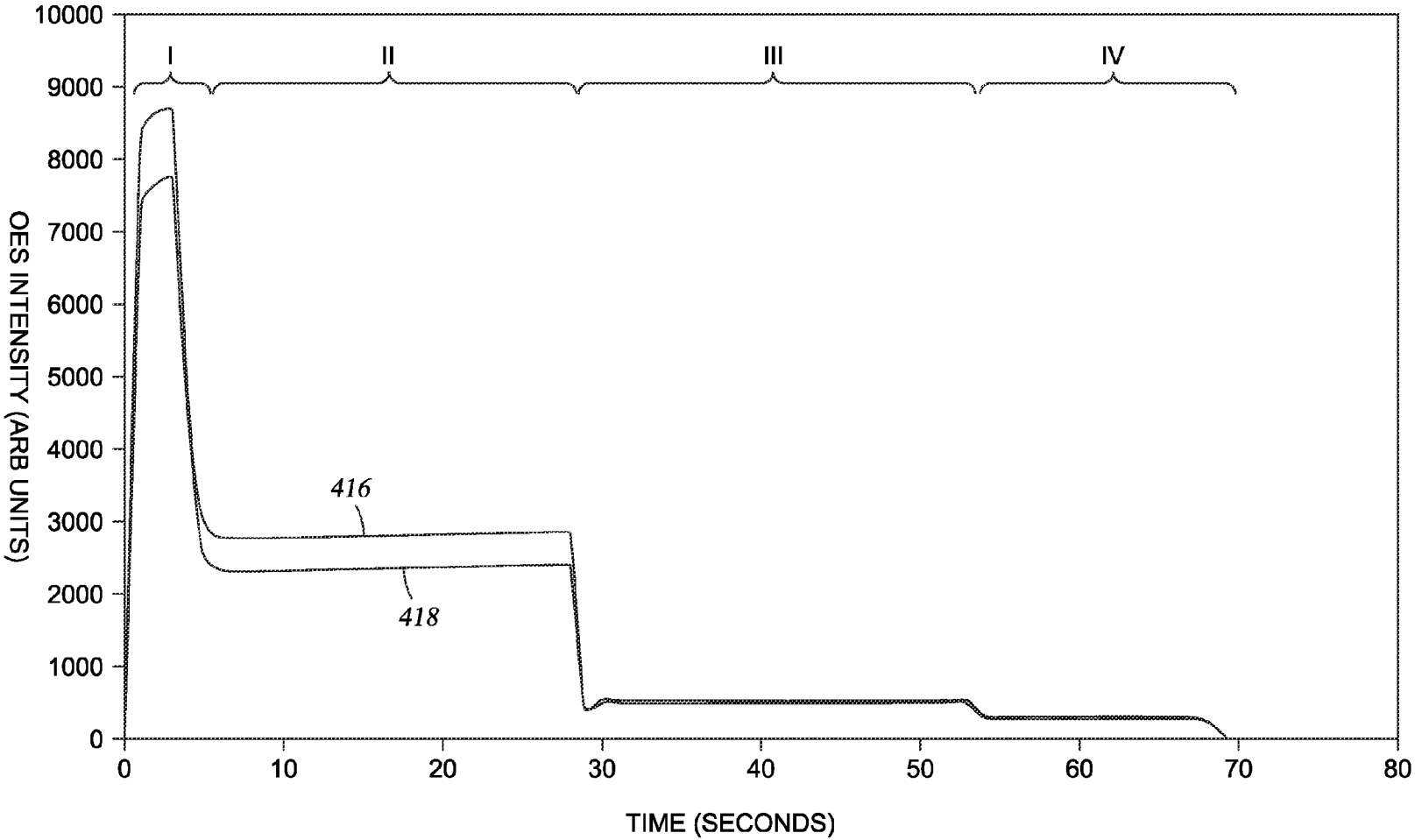
FIGS. 11A and 11B are process charts depicting optical emission spectroscopy (OES) intensity results over time through the phases of ignition (I), passivation (II), a first stripping (III), and a second stripping (IV) using one using a 656 nanometer wavelength and a 777 nanometer wavelength, respectively.
Figure 11B:
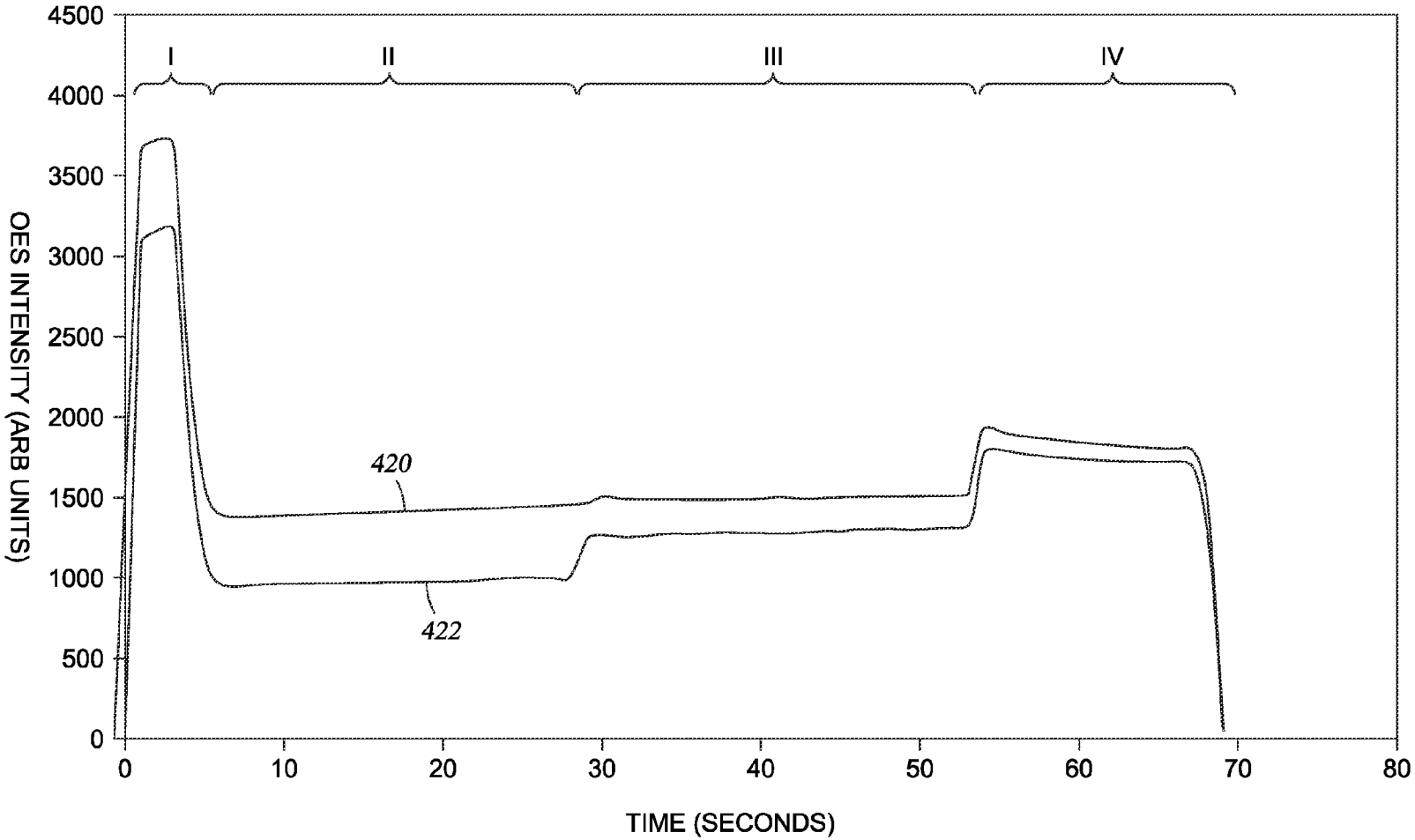

FIGS. 11A and 11B show optical emission spectroscopy (OES) intensity results over time through the phases of ignition (I), passivation (II), a first stripping (III), and a second stripping (IV) using a 656 nanometer wavelength and a 777 nanometer wavelength, respectively. Optical emission spectroscopy is a non-evasive diagnostic approach to investigate atoms, ions and molecules within the plasma 202. This approach may provide information about properties, for example, species densities, collision effects, energy distribution of species, charge transfer between plasma constituents, and electric and magnetic fields. In this case, the lower intensity values depicted are desirable as a measure of the plasma to be free from contaminants, such as the particulates 50. The OES intensity results 418, 422 for these phases provided by the remote plasma source 200 employing the dielectric conduit assembly 206 are at least as desirable as the OES intensity results 416, 420 provided by the conventional remote plasma source 12.

Figure 12:
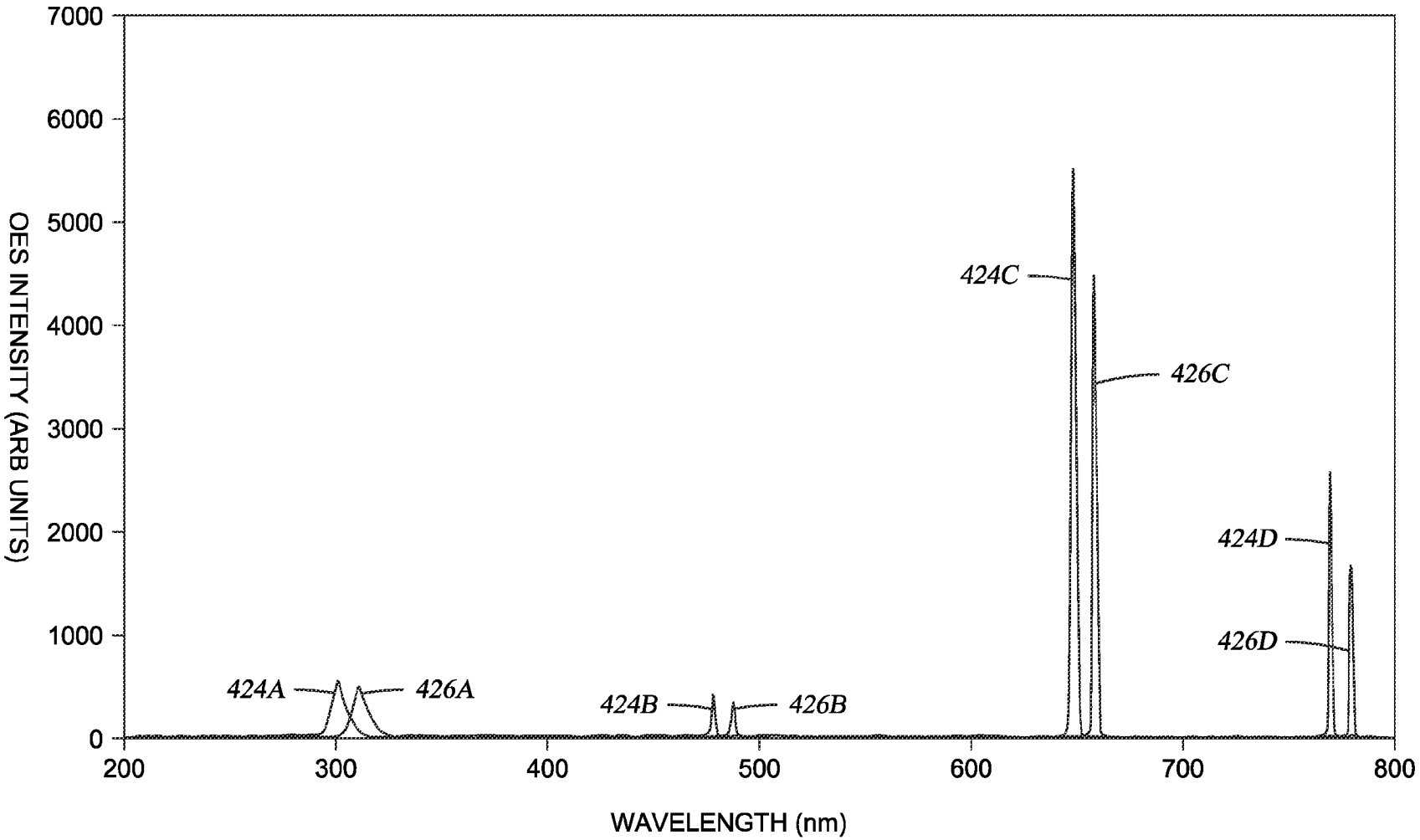
FIGS. 12 through 14 are process charts depicting an OES emission spectrum of the plasma produced during the passivation phase, first stripping phase, and second stripping phase, respectively, illustrating OES emission peaks indicating possible contamination provided by the plasma produced by the remote plasma source of FIG. 3B employing the dielectric conduit assembly appear to contain less contamination than the OES emission spectrum peaks provided by the conventional remote plasma source of FIG. 1A.
Figure 13:
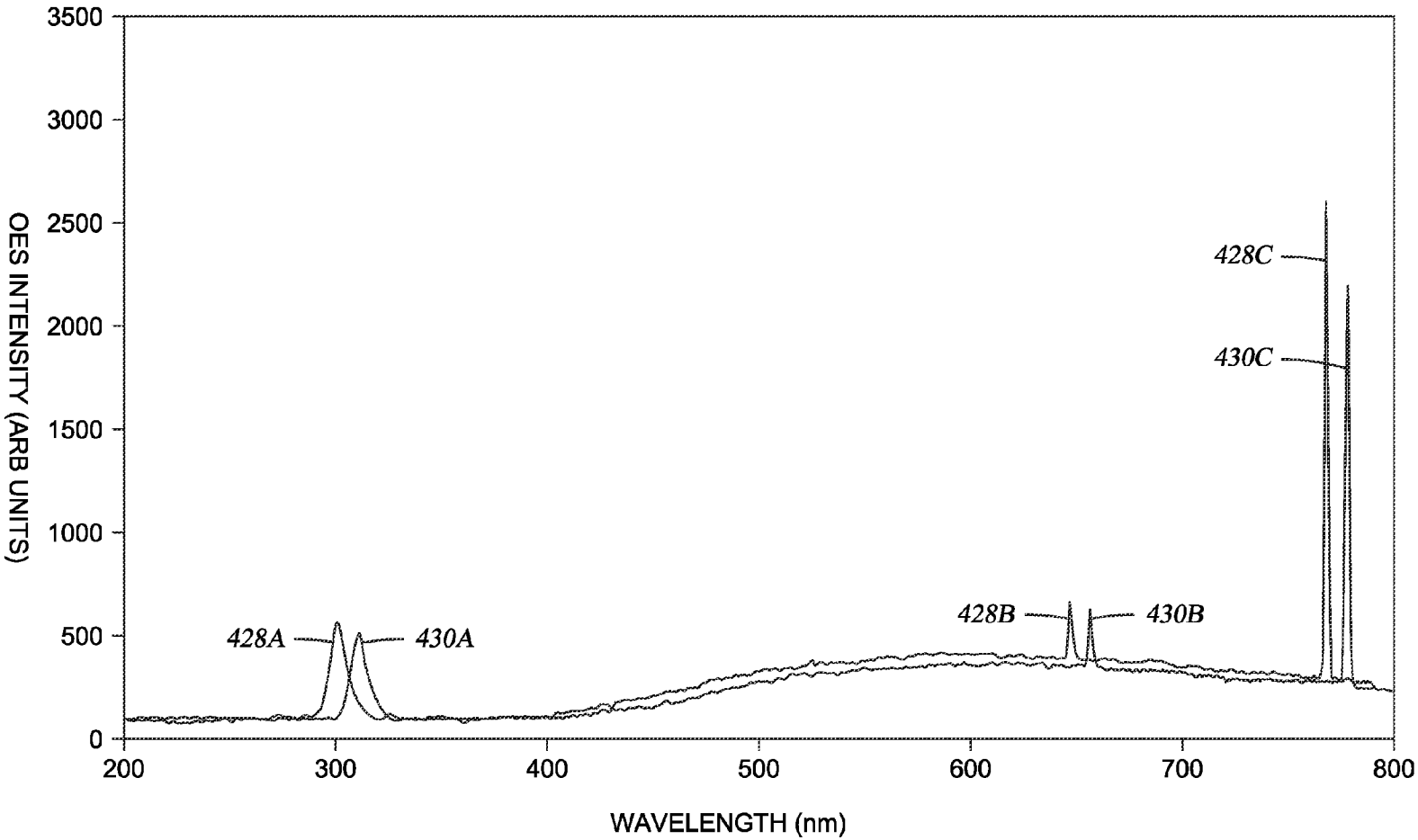
Figure 14:
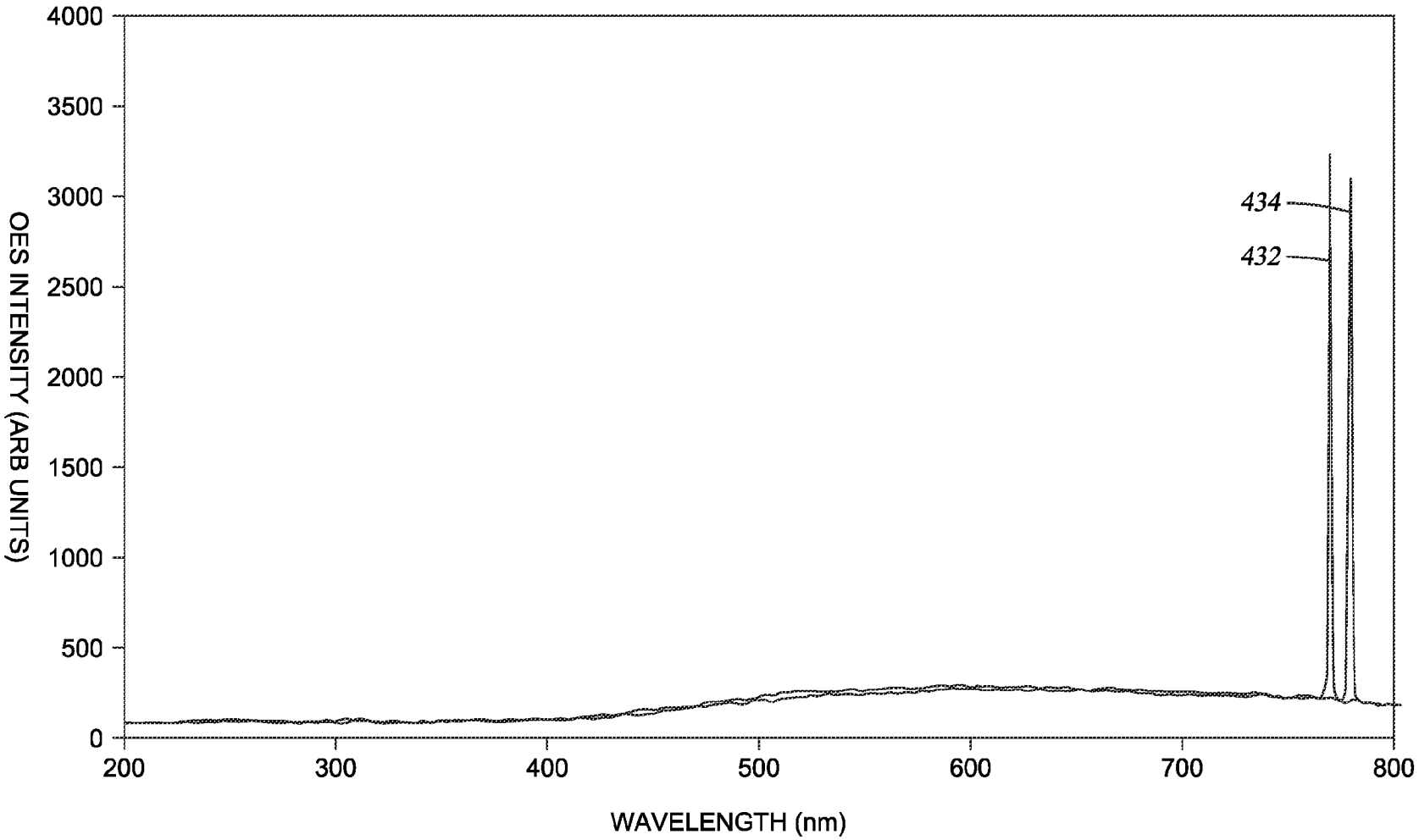

FIGS. 12 through 14 are process charts depicting an OES emission spectrum of the plasma produced during the passivation phase, first stripping phase, and second stripping phase, respectively. OES emission spectrum analysis may be used to better understand a composition of the plasma. In this case, lower intensity values are desirable as a measure of the plasma measured to be free from contaminants, such as the particulates 50. The OES emission spectrum peaks 426A, 426B, 424C, 424D, 430A, 430B, 430C, and 434 measured for the plasma 202 produced, respectively, by the remote plasma source 200 employing the dielectric conduit assembly 206 are as good or better than the OES emission spectrum peaks 424A, 424B, 424C, 424D, 428A, 428B, 428C, 432 provided by the conventional remote plasma source 12. In this manner, the plasma 202 that produced by the remote plasma source 200 employing the dielectric conduit assembly 206 appears to generate less contaminants such as the particulates 50.

As those of ordinary skill in the art can readily appreciate, various conventional components have not been described to enable one to better understand the present invention. In addition, various assembly guides are provided in accordance with any one of a number of methods that are well known to those of ordinary skill in the art to enable assembly of the components for manufacture and for repair.

Many modifications and other embodiments not set forth herein will come to mind to one skilled in the art to which the embodiments pertain having the benefit of the teachings presented in the foregoing descriptions and the associated drawings. It is to be understood that the description and claims are not to be limited to the specific embodiments disclosed and that modifications and other embodiments are intended to be included within the scope of the appended claims. It is intended that the embodiments cover the modifications and variations of the embodiments provided they come within the scope of the appended claims and their equivalents. Although specific terms are employed herein, they are used in a generic and descriptive sense only and not for purposes of limitation.

While the foregoing is directed to embodiments of the present invention, other and further embodiments of the invention may be devised without departing from the basic scope thereof, and the scope thereof is determined by the claims that follow.

The invention claimed is:

1. A plasma generation system, comprising:

an enclosure body forming an internal chamber, an input port, and an output port; and a dielectric conduit assembly disposed within the internal chamber, the dielectric conduit assembly comprising:

a first cross-conduit segment enclosing a first passageway adjacent the input port;

a second cross-conduit segment enclosing a second passageway adjacent the output port; and at least two parallel conduit segments extending from the second cross-conduit segment to distal ends, each parallel conduit segment enclosing an inner space in communication with the second passageway, wherein the first cross-conduit segment has at least two openings for receiving the distal ends of the parallel conduit segments.

2. The plasma generation system of claim 1, wherein the enclosure body is formed of a material comprising aluminum.

3. The plasma generation system of claim 1, wherein the first cross-conduit segment, the second cross-conduit segment and the at least two parallel conduit segments comprise a material including quartz.

4. The plasma generation system of claim 1, wherein the input port of the enclosure body receives a removable input plug including a passageway passing the precursor gas, the input port including a dimension allowing insertion and removal of the first cross-conduit segment therethrough.

5. The plasma generation system of claim 1, wherein a width of the first cross-conduit segment and each width of the at least two parallel conduit segments are a same size or substantially a same size.

6. The plasma generation system of claim 1, wherein each of the at least two openings of the first cross-conduit segment is formed by a plurality of first surfaces, the plurality of surfaces comprising two first coplanar surfaces angled to a longitudinal axis of the first cross-conduit segment.

7. The plasma generation system of claim 6, wherein each of the distal ends of the parallel conduit segments is formed by a plurality of secondary surfaces, the plurality of secondary surfaces comprising two complementary coplanar surfaces angled to the longitudinal axes of the at least two parallel conduit segments.

8. The plasma generation system of claim 7, wherein the two complementary coplanar surfaces are configured to support the two first coplanar surfaces.

9. The plasma generation system of claim 8, wherein the plurality of secondary surfaces of each of the distal ends of the parallel conduit segments further comprises two contoured medial surfaces connecting the two complementary coplanar surfaces, the two contoured medial surfaces are disposed to follow a shape of an inner surface of the first cross-conduit segment when the two complementary coplanar surfaces support the two first coplanar surfaces.

10. The plasma generation system of claim 8, wherein the plurality of first surfaces further comprises two first medial surfaces, the two first medial surfaces connect ends of the two first coplanar surfaces and are disposed to follow a shape of an external surface of a respective one of the at least two parallel conduit segments when the two complementary coplanar surfaces support the two first coplanar surfaces.

11. The plasma generation system of claim 9, wherein the shape of the inner surface of the first cross-conduit segment being concentric or substantially concentric to a longitudinal axis of the first cross-conduit segment.

12. The plasma generation system of claim 10, wherein the shape of the external surface of the respective one of the at least two parallel conduit segments being concentric or substantially concentric to a longitudinal axis of the respective one of the at least two parallel conduit segments.

13. The plasma generation system of claim 9, wherein each of the two first medial surfaces are disposed in complementary shapes of an external surface of the respective at least two parallel conduit segments.

14. The plasma generation system of claim 8, wherein the longitudinal axes of the parallel conduit segments are orthogonal or substantially orthogonal with the longitudinal axis of the first cross-conduit segment when the two complementary coplanar surfaces support the two first coplanar surfaces.

15. The plasma generation system of claim 8, wherein the longitudinal axes of the parallel conduit segments are orthogonal or substantially orthogonal with the longitudinal axis of the first cross-conduit segment when the two complementary coplanar surfaces support the two first coplanar surfaces.

16. The plasma generation system of claim 1, wherein the first cross-conduit segment being restricted from moving parallel along a longitudinal axis of the first cross-conduit segment when the distal ends of the at least two parallel conduit segments are received by the at least two openings of the first cross-conduit segment.

17. A method of installing a dielectric conduit assembly into a remote plasma source, comprising:

providing an enclosure body of the remote plasma source, the enclosure body forming an internal chamber, an input port, and an output port; and providing the dielectric conduit assembly comprising:

a first cross-conduit segment enclosing a first passageway;

a second cross-conduit segment enclosing a second passageway; and at least two parallel conduit segments extending from the second cross-conduit segment to distal ends, each parallel conduit segment enclosing an inner space in communication with the second passageway, wherein the first cross-conduit segment has at least two openings for receiving the distal ends of the parallel conduit segments.

18. The method of claim 17, further comprising inserting the first cross-conduit segment of the dielectric conduit assembly into the internal chamber of the enclosure body through the input port.

19. The method of claim 17, further comprising inserting the second cross-conduit segment and the at least two parallel conduit segments into the internal chamber through the output port.

20. The method of claim 19, further comprising receiving the distal ends of the parallel conduit segments in the at least two openings of the first cross-conduit segment.

* * * * *